US010878761B2

(12) United States Patent
Ji et al.

(10) Patent No.: US 10,878,761 B2
(45) Date of Patent: Dec. 29, 2020

(54) IMAGE DISPLAY PROCESSING METHOD AND DEVICE, DISPLAY DEVICE, AND NON-VOLATILE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Zhihua Ji, Beijing (CN); Wenyu Li, Beijing (CN); Tiankuo Shi, Beijing (CN); Yafei Li, Beijing (CN); Yue Li, Beijing (CN); Yifan Hou, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/558,916

(22) Filed: Sep. 3, 2019

(65) Prior Publication Data

US 2020/0279534 A1 Sep. 3, 2020

(30) Foreign Application Priority Data

Feb. 28, 2019 (CN) ..... 2019 1 0151384

(51) Int. Cl.
*G09G 3/34* (2006.01)
*G09G 3/36* (2006.01)

(52) U.S. Cl.
CPC ..... *G09G 3/342* (2013.01); *G09G 3/36* (2013.01); *G09G 2320/0233* (2013.01); *G09G 2320/0686* (2013.01); *G09G 2340/0407* (2013.01)

(58) Field of Classification Search
CPC ..... G09G 3/342; G09G 2340/0407; G09G 2320/0233; G09G 3/3426; G09G 2320/066; G09G 2320/0626; G09G 2320/0285
See application file for complete search history.

(56) References Cited

U.S. PATENT DOCUMENTS

2003/0184561 A1* 10/2003 Vorst ..... G09B 9/301 345/619
2013/0335538 A1 12/2013 Shestak et al.
(Continued)

FOREIGN PATENT DOCUMENTS

CN 103295553 A 9/2013
CN 103403607 A 11/2013
(Continued)

OTHER PUBLICATIONS

Chinese Office Action in Chinese Application No. 201910151384.X, dated Mar. 10, 2020 with English translation.

*Primary Examiner* — Sanjiv D. Patel
(74) *Attorney, Agent, or Firm* — Collard & Roe, P.C.

(57) ABSTRACT

An image display processing method for a display device, an image display processing device, a display device, and a non-volatile storage medium are provided. The display device includes a display panel and a backlight unit which includes a plurality of backlight blocks and is driven in a local dimming mode. The method includes: determining a first display area and a second display area of the display panel; obtaining backlight values of the backlight blocks, and calculating compensated display data of respective pixels corresponding to the backlight blocks based on the backlight values of the backlight blocks; and adjusting compensated display data of at least one first pixel comprised in the first display area to obtain adjusted display data
(Continued)

of the at least one first pixel. A display resolution of the first display area is larger than a display resolution of the second display area.

19 Claims, 11 Drawing Sheets

(56) References Cited

U.S. PATENT DOCUMENTS

| | | | | |
|---|---|---|---|---|
| 2015/0348469 | A1* | 12/2015 | Otoi | G09G 3/3406 345/690 |
| 2017/0365230 | A1* | 12/2017 | Hu | G09G 5/003 |
| 2020/0051512 | A1* | 2/2020 | Li | G09G 3/3426 |

FOREIGN PATENT DOCUMENTS

| | | | |
|---|---|---|---|
| CN | 109192126 | A | 1/2019 |
| CN | 109388448 | A | 2/2019 |
| JP | 2004-029141 | A | 1/2004 |

* cited by examiner

IMAGE DISPLAY PROCESSING METHOD AND DEVICE, DISPLAY DEVICE, AND NON-VOLATILE STORAGE MEDIUM

CROSS-REFERENCE TO RELATED APPLICATION

The present application claims priority of Chinese Patent Application No. 201910151384.X, filed on Feb. 28, 2019, the disclosure of which is incorporated herein by reference in its entirety as part of the present application.

TECHNICAL FIELD

Embodiments of the present disclosure relate to an image display processing method, an image display processing device, a display device, and a non-volatile storage medium.

BACKGROUND

With continuous improvement of electronic technology level, Virtual Reality (VR) technology or Augmented Reality (AR) technology is as a high and new technology, and has been increasingly applied in daily life such as in games, entertainment, and the like. Virtual Reality technology is also referred to as vision technology or artificial environment.

An existing virtual reality system simulates a virtual three-dimensional world mainly through a high-performance computing system including a central processing unit, and provides a user with a sensory experience of vision, hearing, etc. through a head-mounted device, so that the user can feel as if he is present on the scene, and in addition, human-computer interaction can be carried out.

SUMMARY

At least one embodiment of the present disclosure provides an image display processing method for a display device, the display device comprises a display panel and a backlight unit, the backlight unit comprises a plurality of backlight blocks and is driven in a local dimming mode, and the image display processing method comprises: determining a first display area and a second display area of the display panel; for a frame display image, obtaining backlight values of the plurality of backlight blocks in a case of displaying the frame display image, and calculating compensated display data of respective pixels of the display panel corresponding to the plurality of backlight blocks based on the backlight values of the plurality of backlight blocks; and adjusting compensated display data of at least one first pixel comprised in the first display area to obtain adjusted display data of the at least one first pixel, in which a display resolution of the first display area is larger than a display resolution of the second display area.

For example, the image display processing method provided by some embodiments of the present disclosure further comprises: adjusting compensated display data of at least one pixel comprised in the second display area to obtain adjusted display data of the at least one pixel in the second display area.

For example, in the image display processing method provided by some embodiments of the present disclosure, the second display area comprises a first display sub-area and a second display sub-area, the first display sub-area and the first display area are in a same row, the second display sub-area and the first display area are in different rows, adjusting the compensated display data of the at least one first pixel comprised in the first display area and the compensated display data of the at least one pixel comprised in the second display area comprises: reducing the compensated display data of the at least one first pixel comprised in the first display area and compensated display data of at least one second pixel comprised in the first display sub-area to obtain the adjusted display data of the at least one first pixel and adjusted display data of the at least one second pixel, respectively; the at least one pixel comprised in the second display area comprises the at least one second pixel of the first display sub-area.

For example, in the image display processing method provided by some embodiments of the present disclosure, reducing the compensated display data of the at least one first pixel comprised in the first display area and the compensated display data of at least one second pixel comprised in the first display sub-area comprises: obtaining a mapping relationship between adjusted display data of respective pixels of the display panel and compensated display data of the respective pixels of the display panel; and acquiring, according to the mapping relationship, the adjusted display data of the at least one first pixel comprised in the first display area and the adjusted display data of the at least one second pixel comprised in the first display sub-area.

For example, in the image display processing method provided by some embodiments of the present disclosure, the mapping relationship is expressed as:

$$f(LCD_{com}) = \begin{cases} \sum_{i=0}^{n} a_i LCD_{com}^i & LCD_{com} < \frac{Hm}{2} \\ \sum_{i=0}^{n} b_i LCD_{com}^i & LCD_{com} \geq \frac{Hm}{2} \end{cases}$$

where f ($LCD_{com}$) represents adjusted display data of a pixel of the at least one first pixel comprised in the first display area or adjusted display data of a pixel of the at least one second pixel comprised in the first display sub-area, $LCD_{com}$ represents compensated display data of the pixel, $a_i$ and $b_i$ represent adjustment coefficients of display data in different gray scale ranges, Hm represents a highest gray scale displayed by the pixel, i is an integer greater than or equal to 0 and less than or equal to n, and n is an integer greater than 1.

For example, in the image display processing method provided by some embodiments of the present disclosure, the compensated display data of the pixel is expressed as:

$$LCD_{com} = LCD_{ori} * \left(\frac{Hm}{BL_{PIX}}\right)^{1/2.2}$$

where $LCD_{ori}$ represents display data before compensation of the pixel, and $BL_{PIX}$ represents an actual backlight value corresponding to the pixel and obtained by a backlight diffusion model.

For example, in the image display processing method provided by some embodiments of the present disclosure, adjusting the compensated display data of the at least one pixel comprised in the second display area further comprises: maintaining compensated display data of at least one pixel comprised in the second display sub-area unchanged.

For example, in the image display processing method provided by some embodiments of the present disclosure, the second display sub-area comprises a third display sub-area and a fourth display sub-area; the third display sub-area and a boundary portion, which is adjacent to the second display sub-area, in the first display area and the first display sub-area correspond to a same row of backlight blocks; and the fourth display sub-area and the boundary portion, which is adjacent to the second display sub-area, in the first display area and the first display sub-area correspond to different rows of backlight blocks, respectively.

For example, in the image display processing method provided by some embodiments of the present disclosure, adjusting the compensated display data of the at least one first pixel comprised in the first display area and the compensated display data of the at least one pixel comprised in the second display area comprises: reducing backlight values of a plurality of rows of backlight blocks corresponding to the first display area, the first display sub-area, and the third display sub-area respectively; according to the backlight values of the plurality of rows of backlight blocks corresponding to the first display area, the first display sub-area, and the third display sub-area respectively, acquiring the compensated display data of the at least one first pixel comprised in the first display area, the compensated display data of the at least one second pixel comprised in the first display sub-area, and compensated display data of at least one third pixel comprised in the third display sub-area again; increasing the compensated display data of the at least one third pixel comprised in the third display sub-area to obtain adjusted display data of the at least one third pixel comprised in the third display sub-area; and reducing the compensated display data of the at least one first pixel comprised in the first display area and the compensated display data of the at least one second pixel comprised in the first display sub-area, to obtain adjusted display data of the at least one first pixel comprised in the first display area and adjusted display data of the at least one second pixel comprised in the first display sub-area.

For example, the image display processing method provided by some embodiments of the present disclosure further comprises: maintaining compensated display data of at least one pixel comprised in the fourth display sub-area and backlight values of at least one row of backlight blocks corresponding to the fourth display sub-area unchanged.

For example, the image display processing method provided by some embodiments of the present disclosure further comprises: transmitting the backlight values of the plurality of backlight blocks to the backlight unit; transmitting the adjusted display data of the at least one first pixel comprised in the first display area and the adjusted display data of the at least one second pixel comprised in the first display sub-area to the display panel through a drive circuit that is configured to turn on a single row each time; and transmitting adjusted display data of at least one pixel comprised in the second display sub-area to the display panel through a drive circuit that is configured to turn on rows each time, to perform a display operation of the display panel.

At least one embodiment of the present disclosure further provides an image display processing device for a display device, the display device comprises a display panel and a backlight unit, the backlight unit comprises a plurality of backlight blocks and is driven in a local dimming mode, the image display processing device comprises a display area determination unit, a display data acquisition unit, and a first adjustment unit. The display area determination unit is configured to determine a first display area and a second display area of the display panel; the display data acquisition unit is configured to obtain backlight values of the plurality of backlight blocks, and calculate compensated display data of respective pixels of the display panel corresponding to the plurality of backlight blocks based on the backlight values of the plurality of backlight blocks; and the first adjustment unit is configured to adjust compensated display data of at least one first pixel comprised in the first display area to obtain adjusted display data of the at least one first pixel; a display resolution of the first display area is larger than a display resolution of the second display area.

For example, the image display processing device provided by some embodiments of the present disclosure further comprises: a second adjustment unit, and the second adjustment unit is configured to adjust compensated display data of at least one pixel comprised in the second display area to obtain adjusted display data of the at least one pixel in the second display area.

For example, in the image display processing device provided by some embodiments of the present disclosure, the second display area comprises a first display sub-area and a second display sub-area, the first display sub-area and the first display area are in a same row, the second display sub-area and the first display area are in different rows, the first adjustment unit is configured to reduce the compensated display data of the at least one first pixel comprised in the first display area to obtain the adjusted display data of the at least one first pixel, and the second adjustment unit is configured to reduce compensated display data of at least one second pixel comprised in the first display sub-area to obtain adjusted display data of the at least one second pixel.

At least one embodiment of the present disclosure further provides an image display processing device for a display device, and the image display processing device comprises: a processor and a memory storing one or more computer program modules, the one or more computer program modules are configured to be executed by the processor, and the one or more computer program modules comprise instructions for performing the image display processing method according to any one of the embodiments of the present disclosure.

At least one embodiment of the present disclosure further provides a display device, comprising the image display processing device according to any one of the embodiments of the present disclosure.

For example, the display device provided by some embodiments of the present disclosure further comprises: the display panel and the backlight unit, the backlight unit comprises a plurality of backlight blocks and is driven in a local dimming mode; and the display panel is configured to display an image according to adjusted display data obtained by the image display processing device.

At least one embodiment of the present disclosure further provides a non-volatile storage medium, the non-volatile storage medium stores computer readable instructions non-temporarily, and the image display processing method according to any one of the embodiments of the present disclosure is performed when the computer readable instructions are executed by a computer.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
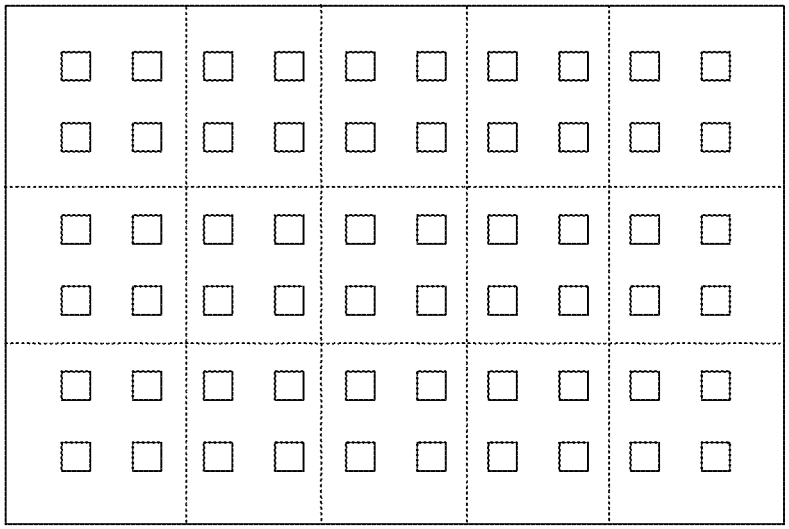
FIG. 1A is a schematic diagram of a backlight unit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the absolute position of the object which is described is changed, the relative position relationship may be changed accordingly.

The present disclosure is described below with reference to some specific embodiments. In order to enable the following description of the embodiments of the present disclosure clear and concise, the present disclosure omits detailed description of known functions and known components. In a case where any component according to an embodiment of the present disclosure appears in more than one drawings, the component is denoted by the same or similar reference numerals in each drawing.

A liquid crystal display panel includes a liquid crystal panel and a backlight unit. Generally, a liquid crystal panel includes an array substrate and an opposite substrate (for example, a color filter substrate) disposed opposite to each other to form a liquid crystal cell, and a liquid crystal layer is filled between the array substrate and the opposite substrate in the liquid crystal cell. A first polarizer is on the array substrate, and a second polarizer is on the opposite substrate, and a polarization direction of the first polarizer is perpendicular to a polarization direction of the second polarizer, for example. The backlight unit is on a non-display side of the liquid crystal panel for providing a planar light source for the liquid crystal panel. The liquid crystal panel comprises a sub-pixel array, and the sub-pixel array comprises a plurality of rows and a plurality of columns, which form a regular matrix (m rows*n columns, and m and n are positive integers), for example. Each sub-pixel comprises a switching element, a pixel electrode, and a common electrode. The switching element is electrically connected to a gate line in a row, in which the sub-pixel is located, and to a data line in a column, in which the sub-pixel is located. And the switching element is also electrically connected to the pixel electrode. Under control of a scan signal on the gate line, the switching element is turned on, thereby transferring a data signal applied on the data line to the pixel electrode to charge the pixel electrode. Liquid crystal molecules of the liquid crystal layer are twisted under an action of a driving electric field formed between a pixel electrode on the array substrate and a common electrode on the array substrate or a common electrode on the opposite substrate, thereby controlling a polarization direction of light passing through the liquid crystal layer, and transmittance of the light is controlled by the cooperation of the first polarizer and the second polarizer, thereby achieving grayscale display.

The backlight unit may be a direct-lit backlight unit or a side-lit backlight unit. A direct-lit backlight unit includes a plurality of point light sources (for example, light-emitting diodes (LEDs)) arranged side by side and a diffusion plate. Light emitted by the point light sources is homogenized by the diffusion plate, and then incident on the liquid crystal panel for display.

At present, high-resolution liquid crystal display panels are also gradually applied to VR devices. During use of a VR device, because the human eyes are relatively close to a display screen, the human eyes are easier to perceive a display effect of a display image, and therefore, the requirements for a resolution and a display quality of the display panel are also getting higher and higher.

For example, for the liquid crystal display panel, the direct-lit backlight unit can be controlled by local dimming (LD) technology, so as to improve the display quality of the display panel. The local dimming technology can not only reduce power consumption of the display panel, but also achieve dynamic dimming of a backlight area, thus greatly improving the contrast of a display image and improving the display quality of the display panel.

The local dimming technology can divide an entire backlight unit into a plurality of backlight blocks which can be driven individually, and each of the plurality of backlight blocks includes one or more LEDs. For example, the local dimming technology can separately control and adjust the light intensity of the plurality of backlight blocks. For example, according to gray scales that need to be displayed in different parts of the display screen, driving currents of the LEDs of the backlight blocks corresponding to these parts are automatically adjusted, so that brightness of each block in the backlight unit is separately adjusted, thereby improving the contrast of the display screen. The local dimming technology is generally only applicable to the direct-lit backlight unit, and a plurality of LEDs as the light sources are evenly distributed throughout an entire backplane, for example.

For example, in an exemplary direct-lit backlight unit, a schematic diagram of dividing regions of the LED light sources in the entire backplane is shown in FIG. 1A. A small square as shown in FIG. 1A represents an LED unit, and a plurality of regions separated by broken lines represent a plurality of backlight blocks. Each of the plurality of backlight blocks includes one or more LED units and can be controlled independently of other backlight blocks. For example, the LEDs in each of the plurality of backlight blocks are linked, for example, connected in series, that is, currents passing through the LEDs located in the same backlight block are consistent, so that the luminance brightness is substantially the same.

Figure 1B:
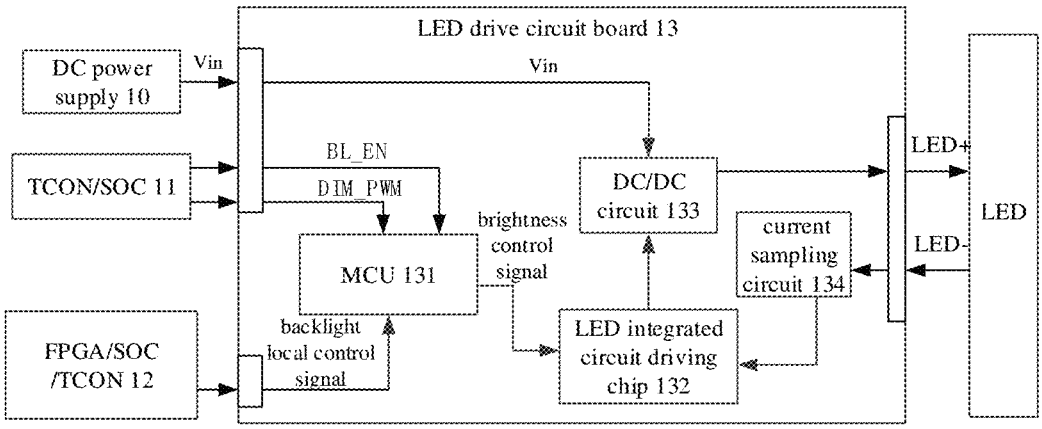
FIG. 1B is a schematic diagram of an exemplary system for performing local dimming on the backlight unit as shown in FIG. 1A.

FIG. 1B is a schematic diagram of an exemplary system for performing local dimming processing on the backlight unit as shown in FIG. 1A. For example, in some examples, the system is implemented by a hardware circuitry. As shown in FIG. 1B, the system includes, for example, a DC power supply 10, a TCON (Timer Control Register)/SOC (System On Chip) 11, an FPGA (Field-Programmable Gate Array)/SOC/TCON 12, and an LED drive circuit board 13 for driving the LEDs to emit light. As shown in FIG. 1B, the LED drive circuit board 13 includes a micro-chip unit (MCU) 131, an LED integrated circuit driving chip 132, a DC/DC circuit 133, and a current sampling circuit 134. The LED drive circuit board 13 is configured to process each frame of image signal to obtain processed backlight brightness data of respective backlight blocks, and generate driving currents used for various backlight blocks based on the backlight brightness data. The driving currents are output to the corresponding backlight blocks to drive the LEDs in the corresponding backlight blocks to emit light by currents.

The MCU 131 receives a backlight local control signal (Local Dimming SPI (Serial Peripheral Interface) signal) from the FPGA/SOC/TCON 12, and the backlight local control signal is used in an "AND" operation (controlling whether the "AND" operation is performed according to an enable signal (BL_EN)) with a brightness modulation signal (DIM_PWM) from the TCON 11 to obtain brightness control signals of the respective backlight blocks. Then, the MCU 131 outputs the brightness control signals to the LED integrated circuit driving chip 132 to implement current control of the LEDs of the respective backlight blocks, thereby controlling the light-emitting brightness of the respective backlight blocks.

For example, the system of performing the local dimming process is powered by an external DC power source 10, and the supply voltage Vin of the power source 10 is typically 24 voltages (V). For example, the DC/DC circuit 133 can employ a voltage conversion circuit (e.g., a Boost circuit) to boost the supply voltage Vin to a driving voltage required by illuminating the LEDs of the respective backlight blocks.

Because even a small fluctuation of a working voltage applied to the LEDs may cause a large change of the current flowing though the LEDs, the LEDs in the system can be dimmed by a constant-current control mode. To achieve the constant-current control, cathode electrodes (LED−) of the plurality of LEDs connected in series in each of the plurality of backlight blocks are connected to the current sampling circuit 134 to monitor the stability of the currents flowing though LEDs that are driven in real time. The current sampling circuit 134 converts the currents flowing through the LEDs into voltage signals and feeds the voltage signals back to the LED integrated circuit driving chip 132, and then the LED integrated circuit driving chip 132 feeds the voltage signals back to the DC/DC circuit 133. After receiving the voltage signals, the DC/DC circuit 133 adjusts output voltages input to anode electrodes (LED+) of the LEDs to achieve a steady current effect on the LEDs. For example, the converted voltage signals are sampled and the sampled voltage signals are compared to a preset reference voltage. In a case where the sampled voltage signals are higher than the preset reference voltage, the current sampling circuit 134 outputs a control signal to enable the DC/DC circuit 133 reduce the output voltage, thereby reducing the currents flowing through the LEDs; otherwise, the current sampling circuit 134 outputs another control signal to enable the DC/DC circuit 133 boost the output voltage to increase the currents flowing through the LEDs. That is, the current sampling circuit 134 can be used as a negative feedback circuit to achieve the constant-current control to the LEDs to enable the LEDs to work stably.

Each of the exemplary backlight units illustrated in FIGS. 1A and 1B comprises a plurality of rectangular backlight regions arranged in an array, the local dimming technology can adjust the brightness and darkness of the corresponding backlight blocks according to gray scales of a screen content displayed on the liquid crystal display panel, for a part with higher brightness (gray scale) of a picture, the brightness of the corresponding backlight blocks is also high; and for a part with a lower brightness of the picture, the brightness of the corresponding backlight blocks is also low, thereby achieving a purpose of reducing backlight power consumption, improving the contrast of the display screen, and enhancing the image quality.

For example, in a VR system, the visual tracking technology in SmartView technology can be used to determine a gaze area of the user's eyes, high-resolution rendering is only performed on the gaze area of the user's eyes, and low-resolution rendering is performed on areas other than the gaze area, thereby reducing the rendering pressure, reducing the power consumption of the display panel, and improving the contrast of the display panel. For example, in order to achieve high-resolution rendering of the gaze area, first, a low-resolution display image that needs to be rendered can be stretched into a high-resolution display image by the IC drive circuit, and then the high-resolution display image is displayed on the display panel, so that the bandwidth of the image transmission can be reduced to some extent, the frame refresh frequency of the image rendering and the refresh frame rate of the VR system can be improved. For example, in the VR system, by combining SmartView technology with the local dimming technology, the dual effects of reducing backlight power consumption and improving image quality contrast can be achieved.

Figure 1C:
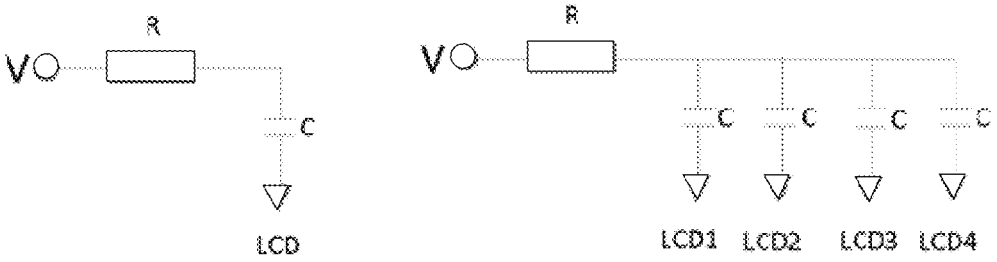
FIG. 1C is a schematic diagram of driving of an IC drive circuit.

FIG. 1C is a schematic drive diagram of an IC drive circuit when SmartView technology is applied. For example, after the gaze area, that is, an area where the high-resolution display image needs to be displayed, is determined by the visual tracking technology of the SmartView technology, the other area is a display area of the low-resolution display image. For example, the display area of the high-resolution display image can be driven to display by using a drive circuit that is configured to turn on a single row each time as shown in the left side of FIG. 1C, and the display area of the low-resolution display image can be driven to display by using a four-row turned-on-simultaneous drive circuit as shown in the right side of FIG. 1C.

Figure 1D:
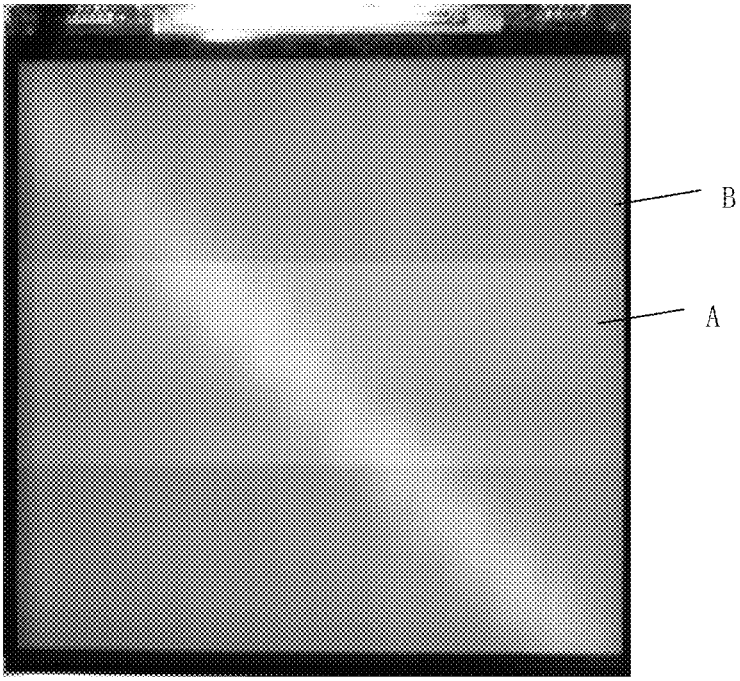
FIG. 1D is a schematic diagram of a display effect of a display image.

However, in a case where different areas (the display area of high-resolution display image and the display area of low-resolution display image) in the same display image are driven by two drive circuits as shown in FIG. 1C, for the same driving voltage V, pixel units in the display area of high-resolution display image adopts a single-row turned-on-simultaneous driving mode, that is, the driving voltage V drives only one row of pixel units, and therefore, a driving current of the row of pixel units is large; pixel units in the display area of low-resolution display image adopts a four-row turned-on-simultaneous driving mode, that is, the driving voltage V drives four rows of pixel units, and therefore, the driving current of each row of pixel units in the display area of low-resolution display image is smaller than the driving current of the row of pixel units in the display area of high-resolution display image, for example, is ¼ of the driving current of the row of pixel units in the display area of high-resolution display image. Therefore, in a case where the driving voltage is the same and the liquid crystal scan time is constant, a charge amount of a capacitor in a pixel unit, which is driven by the single-row turned-on-simultaneous driving mode, in the display area of high-resolution display image is large, and a charge amount of each capacitor in a pixel unit, which is driven by the four-row turned-on-simultaneous driving mode, in the display area of low-resolution display image is small, thereby causing the deflection angle of the liquid crystal in the pixel unit of the display area of the high-resolution display image to be larger than the deflection angle of the liquid crystal in the pixel unit of the display area of the low-resolution display image, so that the display panel has the display effect as shown in FIG. 1D, that is, the display brightness of the display area A of the high-resolution display image is higher than the display brightness of the display area B of the low-resolution display image, resulting in uneven display brightness of the display panel.

At least one embodiment of the present disclosure provides an image display processing method of a display device. The display device comprises a display panel and a backlight unit, and the backlight unit comprises a plurality of backlight blocks and is driven in a local dimming mode. The image display processing method comprises: determining a first display area and a second display area of the display panel; for a frame display image, obtaining backlight values of the plurality of backlight blocks in a case of displaying the frame display image, and calculating compensated display data of respective pixels of the display panel corresponding to the plurality of backlight blocks based on the backlight values of the plurality of backlight blocks; and adjusting compensated display data of at least one first pixel comprised in the first display area to obtain adjusted display data of the at least one first pixel. A display resolution of the first display area is larger than a display resolution of the second display area.

At least one embodiment of the present disclosure also provides an image display processing device, a display device, and a non-volatile storage medium corresponding to the image display processing method described above.

The image display processing method provided by the above embodiments of the present disclosure can overcome a problem of uneven display brightness of a display panel due to the SmartView technology, thereby improving the contrast of the display image and the display effect of the screen, and reducing the power consumption of the display panel.

Embodiments of the present disclosure and examples thereof will be described in detail below with reference to the accompanying drawings.

Figure 2A:
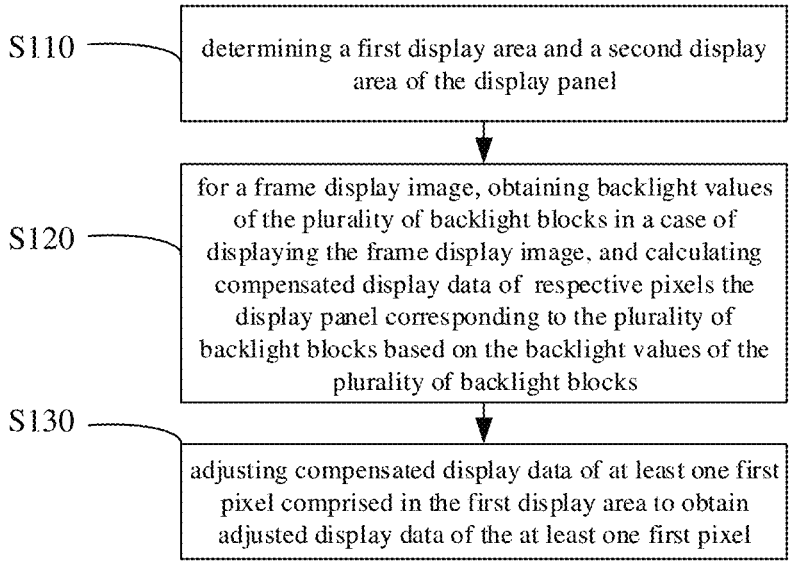
FIG. 2A is a flowchart of an image display processing method provided by some embodiments of the present disclosure.

FIG. 2A is a flowchart of an image display processing method provided by some embodiments of the present disclosure. For example, the display device comprises a display panel and a backlight unit, and the backlight unit is on a non-display side of the display panel, comprises a plurality of backlight blocks, and is driven in a local dimming mode. For example, the plurality of backlight blocks of the backlight unit may be disposed in an array arrangement as shown in FIG. 1A, for example, comprising a plurality of rows (such as, at least three rows) and a plurality of columns (such as, at least five columns), the plurality of backlight blocks of the backlight unit may also be disposed in other manners, for example, in an irregular arrangement manner, and the embodiments of the present disclosure are not limited thereto. For example, the display device may be a liquid crystal display (LCD) device, an electronic paper display device, or the like, for example, the display device may be a virtual reality device such as a virtual display helmet or the like. Correspondingly, the display panel of the display device may be a liquid crystal display panel, an electronic paper display panel, or the like, and the embodiments of the present disclosure are not limited to the specific structure and type of the display panel (for example, a vertical electric field type liquid crystal display panel or a horizontal electric field type liquid crystal display panel).

The image display processing method of some embodiments of the present disclosure may be implemented in a software manner, loaded and executed by a processor in a display panel, for example, loaded and executed by a graphics processing unit (GPU) in the display panel; or at least part of the image display processing method of some embodiments of the present disclosure may be implemented in software, hardware, firmware, or any combination thereof, so as to solve the problem of uneven display brightness of the display panel and improve the display quality of the screen. For example, the graphics processing unit may be an internal component of the display device (for example, an integral form of the VR system), or may be a component of an external device (for example, a computer) of the display device (for example, a split type of the VR system), and the embodiments of the present disclosure are not limited thereto.

For example, the LCD display device may further comprise a pixel array, a data decoding circuit, a timing controller, a gate driver, a data driver, a storage device (for example, a flash memory or the like), and the like. The data decoding circuit receives a display input signal and decodes the display input signal to obtain a display data signal; and the timing controller outputs timing signals to control the gate driver, the data driver, etc., to work synchronously, and can perform gamma correction on the display data signal. The processed display data signal is input to the data driver to perform a display operation. These components can be implemented in a manner in the art, the embodiments of the present disclosure are not limited thereto, and these components are not described herein again.

Hereinafter, an image display processing method for a display device provided by some embodiments of the present disclosure will be described with reference to FIG. 2A. As shown in FIG. 2A, the image display processing method comprises steps S110 to S130, and the steps S110 to S130 of the image display processing method and respective exemplary implementations of the steps S110 to S130 are respectively described below.

Step S110: determining a first display area and a second display area of the display panel.

Step S120: for a frame display image, obtaining backlight values of the plurality of backlight blocks in a case of displaying the frame display image, and calculating compensated display data of respective pixels of the display panel corresponding to the plurality of backlight blocks based on the backlight values of the plurality of backlight blocks.

Step S130: adjusting compensated display data of at least one first pixel comprised in the first display area to obtain adjusted display data of the at least one first pixel.

For example, in some embodiments of the present disclosure, the first display area is, for example, a display area of a high-resolution image, the second display area is, for example, a display area of a low-resolution image, that is, a display resolution of the first display area is larger than a display resolution of the second display area. The following embodiments are the same as those described herein, and similar descriptions are not described again.

Figure 2B:
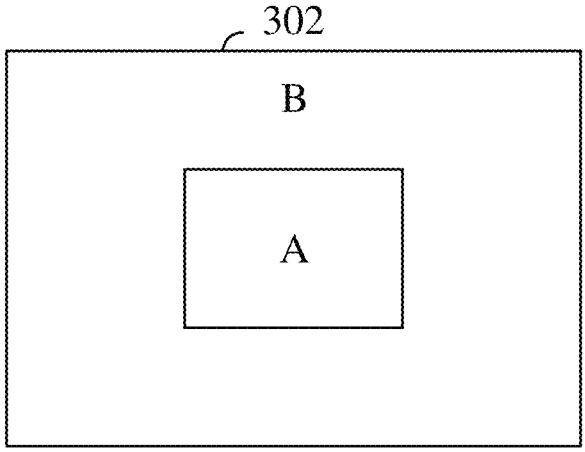
FIG. 2B is a schematic diagram of an example of a first display area and a second display area provided by some embodiments of the present disclosure.

As for the step S110, for example, the first display area and the second display area may be obtained by a visual tracking technology in SmartView technology. FIG. 2B is a schematic diagram of an example of a first display area A and a second display area B provided by some embodiments of the present disclosure, and the specific determination process of the first display area A and the second display area B can be, for example, as follows.

First, for example, an image acquisition device comprising a CMOS (complementary metal oxide semiconductor) sensor, a CCD (charge coupled device) sensor, an infrared camera, or the like can be used to acquire image information of the eyeball of the user and image information around the eyeball. For example, the image acquisition device can be on a side where the display panel is located, for example, be on a frame of a VR device.

Then, the acquired images are analyzed by the visual tracking technology to extract a pupil center of the human eye, for example, a Scale-invariant Feature Transform (SIFT) feature extraction algorithm, a Histogram of Oriented Gradient (HOG) feature extraction algorithm, and other algorithms in the field may be used to extract feature points of the pupil, and determine a pupil contour to determine the pupil center, and the embodiments of the present disclosure are not limited thereto.

After determining the pupil center, a coordinate (x, y) of a fixation point of the pupil center of the human eye on the display panel 302 can be estimated by a certain mathematical model. For example, the first display area A, that is, a gaze area of the user, is an area within a certain range centering on the coordinate (x, y) of the fixation point, for example, as shown in FIG. 2B, the first display area A may be an area centered on the fixation point and respectively having a length and a width of about 15% to 45% of a length and a width of the display area of the display panel 302 viewed by the user, for example, may be an area having a length and a width which are 30% of the length and the width of the display area viewed by the user, and the embodiments of the present disclosure are not limited thereto.

For example, the first display area and the second display area jointly display one frame of display image. In a case where a display resolution (for example, display data) of a frame display image is identical to a physical resolution of the display panel (i.e. the first display area and the second display area), the display data can be directly displayed on the display panel; and in a case where the display resolution of the frame display image is different from the physical resolution of the display panel (i.e. the first display area and the second display area), the display resolution of the display image can be adjusted to be the same as the physical resolution of the display panel and then displayed on the display panel. For example, the display resolution of the display image is an amount of display data of the display image, and the physical resolution of the display panel refers to an amount of pixels of the display panel.

For example, in some embodiments of the present disclosure, a case that a physical resolution of the display panel is 4320*4320 is taken as an example to describe. The first display area A is a display area centered on the fixation point (x, y) and comprising 1440 rows and 1440 columns of pixels, the following embodiments are the same as those described herein, similar descriptions are not described again, however the embodiments of the present disclosure are not limited thereto. For example, as shown in FIG. 2B, the display area further comprises a second display area B, that is, a non-gaze area, located outside the first display area A. For example, the gaze area changes as the coordinate of a position of the pupil center (that is, the fixation point of the human eye) change. For example, if the fixation point of the human eye is at the boundary, the first display area A is a display area with the boundary as a starting edge and comprising 1440 rows and 1440 columns of pixels.

For example, in some examples, a first display image with a display resolution of 1440*1440 and centering on the fixation point is obtained on the software terminal, for example, the first display image is displayed in the first display area A. Because the human eye only looks at the first display area A, the second display area B is a non-gaze area, in order to reduce the transmission load and unnecessary power consumption, the scene of the second display area B can be displayed in a low-definition mode, for example, the low-definition display can be implemented by using a method of four pixel units in each column corresponding to one display data (for example, by using a four-row turned-on-simultaneous driving mode), and therefore, correspondingly, a second display image having a display resolution of 1080*1080 can be acquired on the software terminal, for example, the second display image is displayed on the display panel. For example, for clarity and conciseness of description, an image displayed in the first display area is called the first display image, and an image displayed in the second display area is called the second display image. It should be noted that both the first display image and the second display image belong to one frame display image.

Figure 2C:
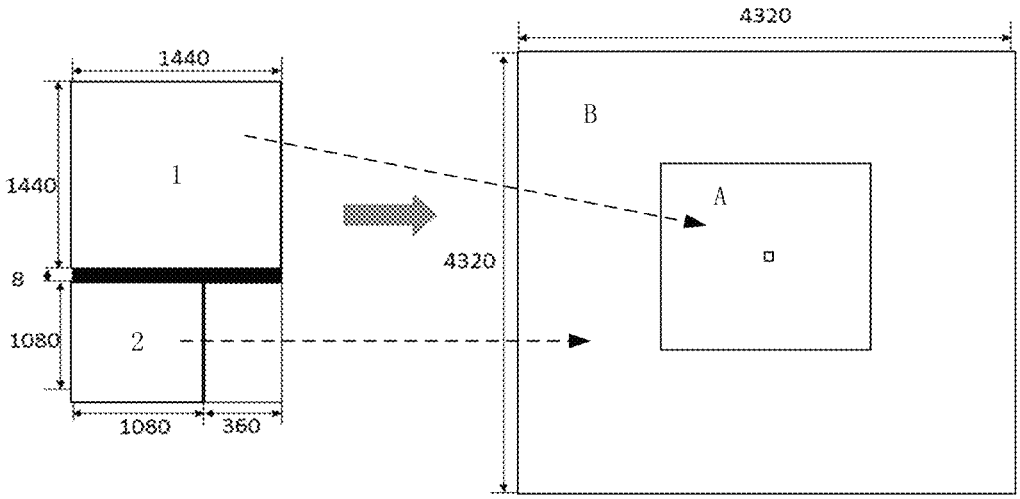
FIG. 2C is a schematic diagram of display data transmission of a display image provided by some embodiments of the present disclosure.

For example, as shown in FIG. 2C, the acquired first display image 1 having a display resolution of 1440*1440 and the acquired second display image 2 having a display resolution of 1080*1080 are transmitted to corresponding areas of the display panel through an IC drive circuit (for example, a data driver and a gate scan driver), so as to be used for the displaying of display images.

It should be noted that, the first display area A is not limited to the shape and position as shown in FIG. 2B. For example, in a case where gaze areas of the two eyes overlap, the first display area A may be a superposition of two gaze areas, for example, a first display area A having a co shape is obtained; in a case where the fixation point of the human eye is at the boundary, the position of the first display area A may also be located around the display panel, and the embodiments of the present disclosure are not limit this.

It should be noted that, a display resolution of a display image may be less than or equal to a physical resolution of the display panel, for example, the physical resolution of the display panel is an integer multiple of the display resolution of the display image, which is not limited by the embodiments of the present disclosure. For example, the physical resolution of the display panel is the highest resolution of the display panel and is also the optimal resolution of the display panel.

For example, the display panel comprises m rows*n columns of pixel units, that is, the physical resolution of the display panel is m*n; for example, the display resolution of the display image indicates that the display image comprises j rows*k columns (for example, j, k are integers larger than 0, and m and n are integer multiples of j and k, respectively) of display data. For example, the j rows*k columns of display data included in the display image is transmitted as data signals through the data lines to the corresponding pixel units of the display panel for display.

For example, in some embodiments of the present disclosure, a case that the physical resolution of the display panel is 4320*4320 is taken as an example, that is, the display panel comprises 4320 rows of pixel units in a horizontal direction, and comprises 4320 columns of pixel units in a vertical direction, and the embodiments of the present disclosure are not limited thereto. For example, in a case where the display resolution of the display image is 1080*1080, because the display resolution of the display image is lower than the physical resolution of the display panel, for example, it can be implemented by a method that four pixel units in each column of the display panel correspondingly display one piece of display data in the display image, thereby achieving the low-definition display, that is, each column of display data of the display image is changed into 4 adjacent columns of display data respectively to convert the display resolution of the display image to be the same as the physical resolution of the display panel; for example, in a case where the display resolution of the display image of the first display area is 1440*1440, because in the display panel, the physical resolution of the first display area A is the same as the display resolution of the display image, and is also 1440*1440, and therefore, respective display data included in the display image may be in one-to-one correspondence with respective pixel units of the display panel, thereby achieving the high-definition display. Therefore, generally, the higher the display resolution of the display image, the better the display effect of the display panel. It should be noted that in a case where the display resolution of the display image is greater than the physical resolution of the display panel, that is, in a case where an amount of the display data of the display image is greater than an amount of pixel units of the display panel, a column of pixel units may be used to correspond to multiple columns of display data, so that the display resolution of the display image is converted to be the same as the physical resolution of the display panel.

For example, a display area determination unit for determining the first display area A and the second display area B of the display panel may be provided, and the first display area A and the second display area B of the display panel are determined by the display area determination unit; for example, the display area determination unit can be implemented by SmartView technology, for example, the display area determination unit can also be implemented by a central processing unit (CPU), a graphics processing unit (GPU), a tensor processing unit (TPU), a field-programmable gate array (FPGA), or other forms of processing unit having data processing capabilities and/or program execution capabilities, and corresponding computer instructions. For example, the processing unit may be a general-purpose processor or a dedicated processor, and may be an X86 or ARM architecture based processor, or the like.

For the step S120, for example, the gray values of the display data of the pixels corresponding to the backlight blocks in respective rows can be separately counted by the histogram. It should be noted that, the gray values of the display data of the pixels corresponding to the backlight blocks in respective rows can also be counted by other statistical methods in the art, which is not limited by the embodiments of the present disclosure.

For example, gray values at 80% to 90% of the counted gray values, which are sorted in an order from small to large, of the display data of the pixels corresponding to the respective backlight blocks are set as the backlight values of the corresponding backlight blocks, or average values of the gray values of the display data of the pixels corresponding to the respective backlight blocks are set as the backlight values of the corresponding backlight blocks. For example, if the display data of the pixels corresponding to a backlight block has 100 pieces of data remaining after filtering out the deviation data, a gray value at 90% of the display data of the pixels corresponding to the backlight block is taken as the backlight value of the backlight block, that is, after sorting the remaining display data from small to large, a 90-th display data of the 100 display data is taken as the backlight value of the backlight block. For example, the display data used in calculating the backlight value of the backlight block may be the display data of the pixels in a current frame display image or the display data of the pixels in a previous frame display image, which is not limited in the embodiments of the present disclosure. For example, when the display panel performs display, the brightness change between a previous frame display image and a next frame display image of the display image is usually small, especially when the display screen is smooth and continuous. For example, the following embodiments are described by taking a case that the display data of the current frame display image is used to calculate the backlight value of each backlight block as an example.

It should be noted that the backlight value of each backlight block can also be determined according to other methods in the art, and the embodiments of the present disclosure are not limited thereto.

For example, after obtaining the backlight values of the respective backlight blocks, compensated display data of each pixel in the current frame display image corresponding to each backlight block may be obtained according to the following formula:

$$LCD_{com} = LCD_{ori} * \left(\frac{Hm}{BL_{PIX}}\right)^{1/2.2} \quad (1)$$

where, $LCD_{com}$ represent the compensated display data of a pixel in the current frame display image, $LCD_{ori}$ represents display data before compensation of the pixel, $BL_{PIX}$ represents an actual backlight value corresponding to the pixel and obtained by a backlight diffusion model, Hm represents the highest gray scale that the pixel displays, and 2.2 represent the gamma value of the gamma curve of the display panel, however the embodiments of the present disclosure are not limited thereto.

For example, Hm may take 255 or 1023, etc., and the specific value of Hm may be determined according to a specific situation (for example, a range of a value of the gray scale signal is, for example, 0 to 255 or 0 to 1023, and the like), and the embodiments of the present disclosure are not limited thereto. For example, the embodiments of the present disclosure are described by taking a case that the value of Hm is 255 as an example, the following embodiments are the same as those described herein, and similar descriptions are not described again.

For example, a case that an actual backlight value of a certain pixel in an area of the display panel corresponding to a backlight block is taken as an example to describe. Because light emitted by respective LEDs in the backlight unit may generate light diffusion, and other phenomena, and therefore, the brightness (that is, the backlight value) of the backlight emitted by the LEDs in different positions in the backlight unit has an effect on the actual backlight brightness (actual backlight value) at the position of the pixel. For example, the closer the distance between the pixel and one LED, the greater the effect of the brightness of the light emitted by the LED on the actual backlight brightness at the position of the pixel, therefore, the combination of the brightness of LEDs, which are located at different distances of the pixel, in the backlight unit at the position of the pixel requires to be integrated, so as to obtain the actual backlight brightness at the position of the pixel. So, the backlight diffusion models of these LEDs at the position of the pixel needs to be fitted according to the distances of respective LEDs in each backlight block to the pixel and the backlight value of each backlight block, and according to these backlight diffusion models, the actual backlight brightness of the pixel is calculated, thereby obtaining the actual backlight brightness of each pixel corresponding to each backlight block. For example, the backlight diffusion models can be actually measured according to methods in the art, and will not be described herein. For example, the backlight diffusion model is a mathematical model of the actual backlight value corresponding to each pixel, the backlight value of the corresponding backlight block, and the distances of respective LEDs in respective backlight blocks to the pixel, so that the compensated display data corresponding to each pixel of the plurality of backlight blocks can be calculated based on the backlight values of the plurality of backlight blocks.

For example, the backlight values of the plurality of backlight blocks and the compensated display data of each pixel of the display panel corresponding to the plurality of backlight blocks may be calculated by an algorithm in the art, and details are not described herein again.

For example, a display data acquisition unit for acquiring the compensated display data of each pixel may be provided, and the backlight values of the plurality of backlight blocks are acquired by the display data acquisition unit, and the compensated display data of the respective pixels corresponding to the plurality of backlight blocks are calculated based on the backlight values of the plurality of backlight blocks; for example, the display data acquisition unit can also be implemented by a central processing unit (CPU), a graphics processing unit (GPU), a tensor processing unit (TPU), a field-programmable gate array (FPGA), or other forms of processing unit having data processing capabilities and/or program execution capabilities, and corresponding computer instructions.

Because the display panel adopts a driving mode as shown in FIG. 1C, therefore, for example, the display brightness of the first display area A is larger than the display brightness of the second display area B, resulting in a phenomenon in which the brightness is uneven as shown in FIG. 1D. For the step S130, for example, the compensated display data of at least one first pixel included in the first display area A may be reduced to obtain adjusted display data of the at least one first pixel.

For example, after reducing the compensated display data of the at least one first pixel included in the first display area A, a deflection angle of a liquid crystal layer in the at least one first pixel is decreased, so that the transmittance of the light emitted by the backlight block corresponding to the at least one first pixel can be reduced, thereby reducing the display brightness of the first display area A and improving the display quality of the display panel.

For example, a first adjustment unit for acquiring adjusted display data of the at least one first pixel may be provided, and the compensated display data of the at least one first pixel included in the first display area A is adjusted by the first adjustment unit to obtain the adjusted display data of the at least one first pixel; for example, the first adjustment unit can also be implemented by a central processing unit (CPU), a graphics processing unit (GPU), a tensor processing unit (TPU), a field-programmable gate array (FPGA), or other forms of processing unit having data processing capabilities and/or program execution capabilities, and corresponding computer instructions.

Figure 3A:
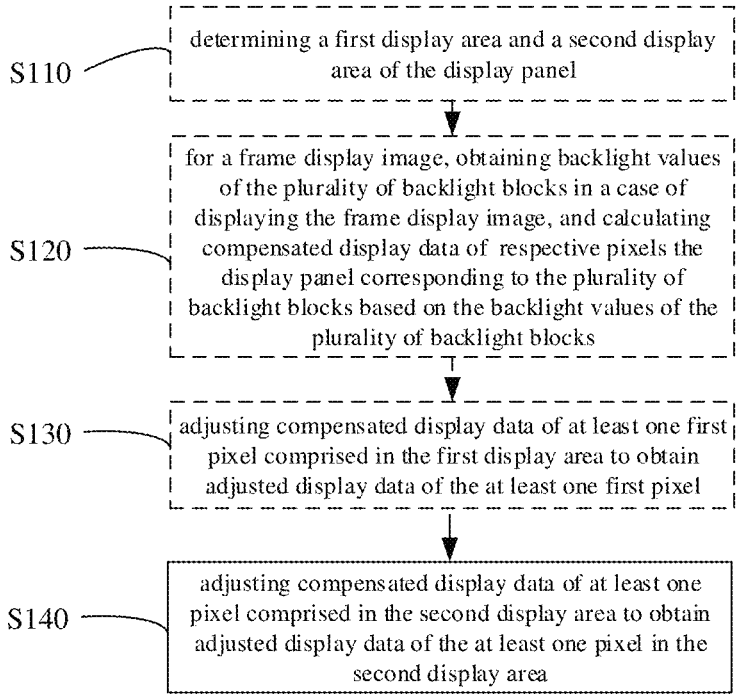
FIG. 3A is a flowchart of another image display processing method provided by some embodiments of the present disclosure.
Figure 3B:
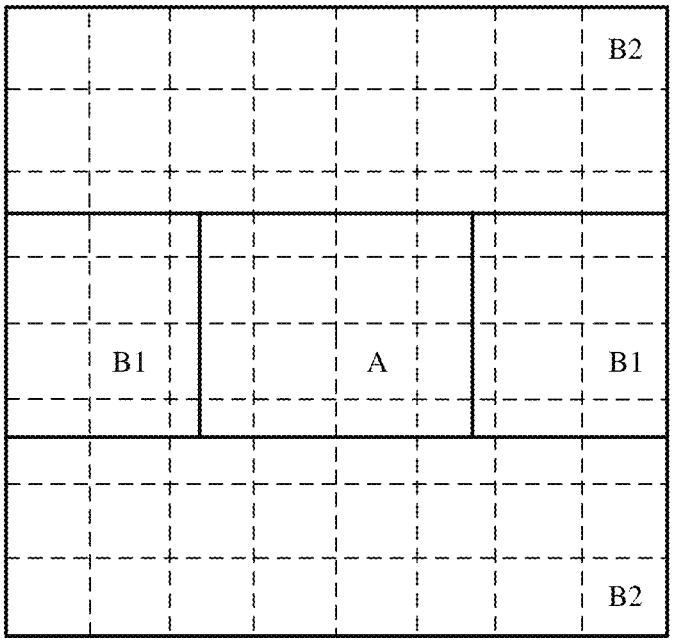
FIG. 3B is a schematic diagram of another example of a first display area and a second display area provided by some embodiments of the present disclosure.

FIG. 3A is a flowchart of another image display processing method provided by some embodiments of the present disclosure; and FIG. 3B is a schematic diagram of another example of a first display area and a second display area provided by some embodiments of the present disclosure. As shown in FIG. 3A, based on the example as shown in FIG. 2A, the image display processing method further comprises correspondingly adjusting compensated display data of pixels in the second display area B to further improve the display quality of the display panel. As shown in FIG. 3A, the image display processing method further comprises a step S140. The step S140 can be described in detail below with reference to FIGS. 3A and 3B.

Step S140: adjusting compensated display data of at least one pixel comprised in the second display area to obtain adjusted display data of at least one pixel in the second display area.

Figure 8:
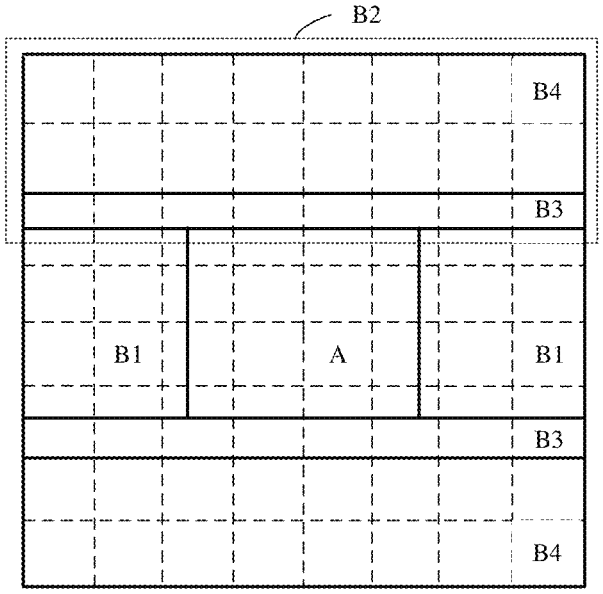
FIG. 8 is a schematic diagram of still another example of a first display area and a second display area provided by some embodiments of the present disclosure.

For example, in some examples, at least one pixel comprised in the second display area B may comprise at least one second pixel comprised in a first display sub-area B1 and at least one pixel comprised in a second display sub-area B2 as shown in FIG. 3B. For example, in another example, at least one pixel comprised in the second display area B may comprise at least one second pixel comprised in a first display sub-area B1, at least one third pixel comprised in a third display sub-area B3, and at least one pixel comprised in a fourth display sub-area B4 as shown in FIG. 8 below. For example, at least one pixel comprised in the second display sub-area B2 are all pixels comprised in the second display sub-area B2, and at least one pixel comprised in the fourth display sub-area B4 are all pixels comprised in the fourth display sub-area B4.

For example, as shown in FIG. 3B, the second display area B comprises a first display sub-area B1 and a second display sub-area B2. For example, as shown in FIG. 3B, the first display sub-area B1 and the first display area A are in the same row, and have the same row height (for example, the number of rows of sub-pixel rows in the display panel); and the second display sub-area B2 and the first display area A are in different rows. The dashed-line boxes shown in FIG. 3B represent respective backlight blocks corresponding to respective display areas of the display panel. It should be noted that a direction of the row in "the same row" or "different rows" in the above description is, for example, the same as a direction of each row in line-by-line scanning process, and the following embodiments are the same and will not be repeated here.

Because the first display sub-area B1 and the first display area A are in the same row, a row drive circuit used in the first display sub-area B1 and a row drive circuit used in the first display area A are the same, that is, a drive circuit that is configured to turn on a single row each time as shown in FIG. 1C is used, and therefore, the display brightness of the first display sub-area B1 and the display brightness of the first display area A are the same, and both are higher than the display brightness of the second display sub-area B2. Therefore, for the step S140, adjusting compensated display data at least one pixel comprised in the second display area B comprises: reducing compensated display data of at least one second pixel comprised in the first display sub-area B1 to obtain the adjusted display data of the at least one second pixel, thereby reducing the display brightness of the first display sub-area B1.

For example, for the step S140, adjusting compensated display data of at least one pixel comprised in the second display area B further comprises: maintaining compensated display data of at least one pixel comprised in the second display sub-area B2 unchanged.

Therefore, by reducing the compensated display data of the first pixel, which has the higher display brightness, in the first display area A and the compensated display data of the second pixel, which has the higher display brightness, in the first display sub-area B1, the transmittance of the light emitted by the backlight blocks corresponding to the first display area A and the first display sub-area B1 is reduced, however the compensated display data of the second display sub-area B2 having the lower display brightness can be kept unchanged, so that the brightness uniformity of the first display area A, the first display sub-area B1, and the second display sub-area B2 is improved, thereby improving the display quality of the display panel.

For example, a second adjustment unit for acquiring the adjusted display data of at least one pixel in the second display area B may be provided, and the compensated display data of at least one pixel included in the second display area B is adjusted by the second adjustment unit to obtain the adjusted display data of at least one pixel included in the second display area B; for example, the second adjustment unit can also be implemented by a central processing unit (CPU), a graphics processing unit (GPU), a tensor processing unit (TPU), a field-programmable gate array (FPGA), or other forms of processing unit having data processing capabilities and/or program execution capabilities, and corresponding computer instructions.

Figure 4:
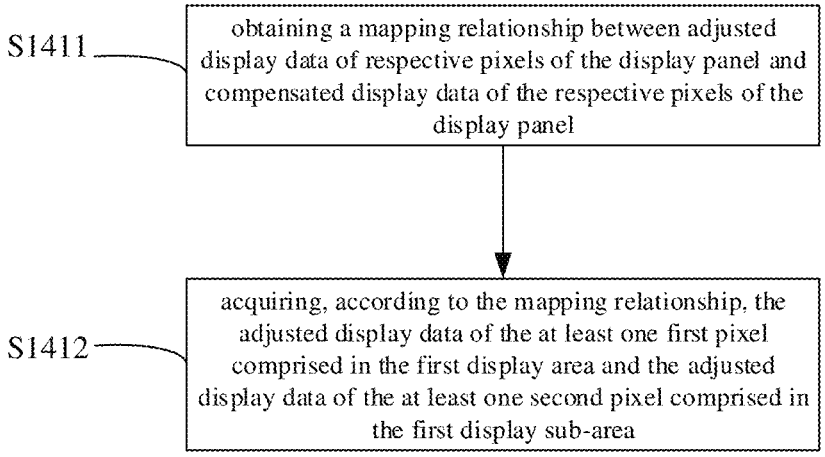
FIG. 4 is a flowchart of an example of acquiring adjusted display data provided by some embodiments of the present disclosure.

FIG. 4 is a flowchart of some examples of acquiring adjusted display data provided by some embodiments of the present disclosure. That is, FIG. 4 is a flowchart of some examples of steps S130 and S140 as shown in FIG. 3A. For example, in the example as shown in FIG. 4, a method of acquiring the adjusted display data comprises steps S1411 to S1412. Hereinafter, an image display processing method of an embodiment of the present disclosure will be described with reference to FIG. 4.

Step S1411: obtaining a mapping relationship between adjusted display data of respective pixels of the display panel and compensated display data of the respective pixels of the display panel.

For the step S1411, for example, in 256 gray scale levels (that is, 0-255) corresponding to the respective pixels of the second display sub-area B2, at least 35 different gray scale values, for example, are taken at intervals, for example, taking 35 different gray scale values, 50 different gray scale values, and the like, and the embodiments of the present disclosure are not limited thereto. For example, the 256 gray scale levels are all compensated display data. For example, in a case where the second display sub-area displays by using one of the above-mentioned, for example, at least 35 different gray scale values, the compensated display data of the first pixel comprised in the first display area A and the compensated display data of the second pixel comprised in the first display sub-area B1 are adjusted by enabling the display brightness of the display panel corresponding to the gray scale uniform, and so on, so that adjusted display data, which are in one-to-one correspondence to at least 35 gray scale levels, in the first display area A and in the first display sub-area B1 can be obtained.

Figure 5:
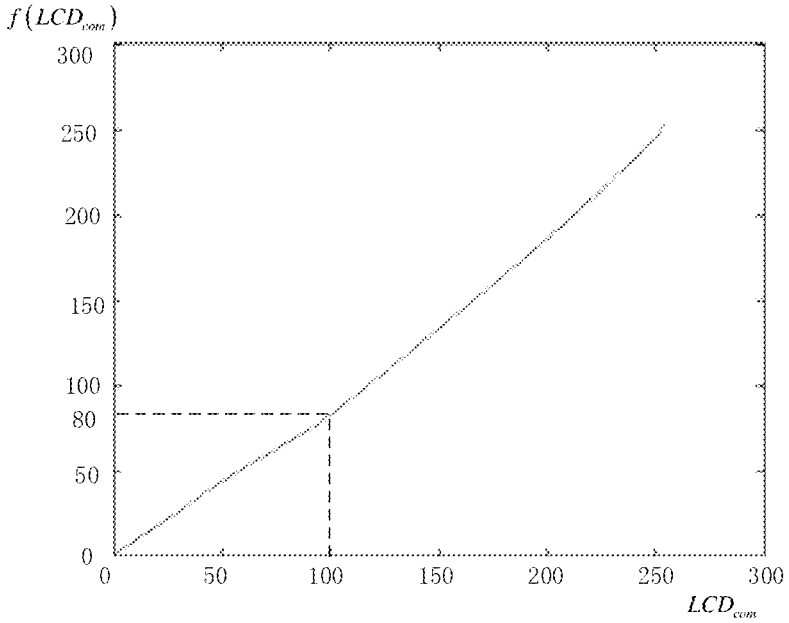
FIG. 5 is a curve fit diagram of adjusted display data and compensated display data provided by some embodiments of the present disclosure.

For example, a two-segment polynomial curve fit is performed based on the at least 35 gray scale levels and the adjusted display data, and a curve fit graph of the adjusted display data and the compensated display data as shown in FIG. 5 can be, for example, obtained. It should be noted that, the curve fit graph as shown in FIG. 5 is only an example, and the specific curve fit result is determined according to actual conditions, and the embodiments of the present disclosure are not limited thereto.

For example, as can be seen from FIG. 5, for example, in a case where a gray scale value of the first pixel (that is, the compensated display data) is 100, the adjusted display data is, for example, 80, that is, the gray scale value is reduced by 20, so as to enable the display brightness of the display panel uniform.

Step S1412: acquiring, according to the mapping relationship, the adjusted display data of the at least one first pixel comprised in the first display area and the adjusted display data of the at least one second pixel comprised in the first display sub-area.

For example, an expression (that is, the mapping relationship) of the two-segment fit curve function as shown in FIG. 5 can be expressed as:

$$f(LCD_{com}) = \begin{cases} \sum_{i=0}^{n} a_i LCD_{com}^i & LCD_{com} < \frac{Hm}{2} \\ \sum_{i=0}^{n} b_i LCD_{com}^i & LCD_{com} \geq \frac{Hm}{2} \end{cases} \quad (2)$$

where f ($LCD_{com}$) represents adjusted display data of a pixel of the at least one first pixel comprised in the first display area A or adjusted display data of a pixel of the at least one second pixel comprised in the first display sub-area B1, $LCD_{com}$ represents compensated display data of the pixel, $a_i$ and $b_i$ represent adjustment coefficients of display data in different gray scale ranges, i is an integer greater than or equal to 0 and less than or equal to n, and n is an integer greater than 1.

For example, the compensated display data of the pixel can be obtained by the formula (1), and repeated portions will be omitted here.

Figure 11:
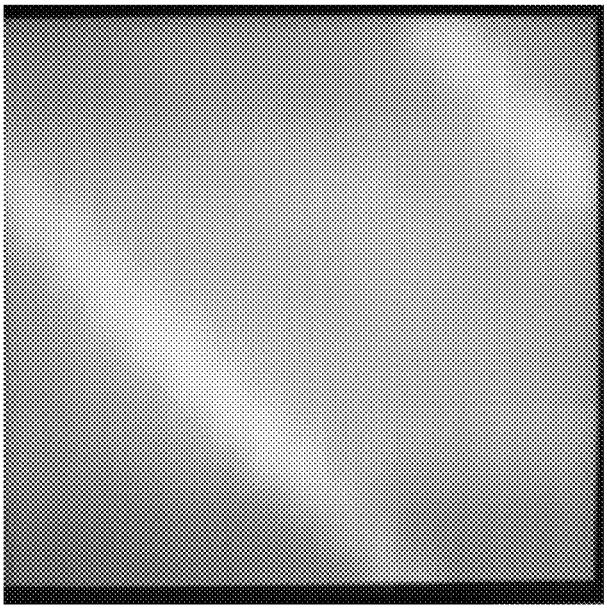
FIG. 11 is a schematic diagram of a display effect of a display image provided by some embodiments of the present disclosure.

For example, the compensated display data of the pixels in the first display area A and the first display sub-area B1 can be adjusted in real time according to the above formula (2), and the adjusted display data is used for driving the corresponding display area of the display panel, so that the display panel reaches the display effect as shown in FIG. 11, thereby solving the phenomenon as shown in FIG. 1D that the display brightness of the display panel is uneven, and improving the display quality of the display panel.

Figure 6:
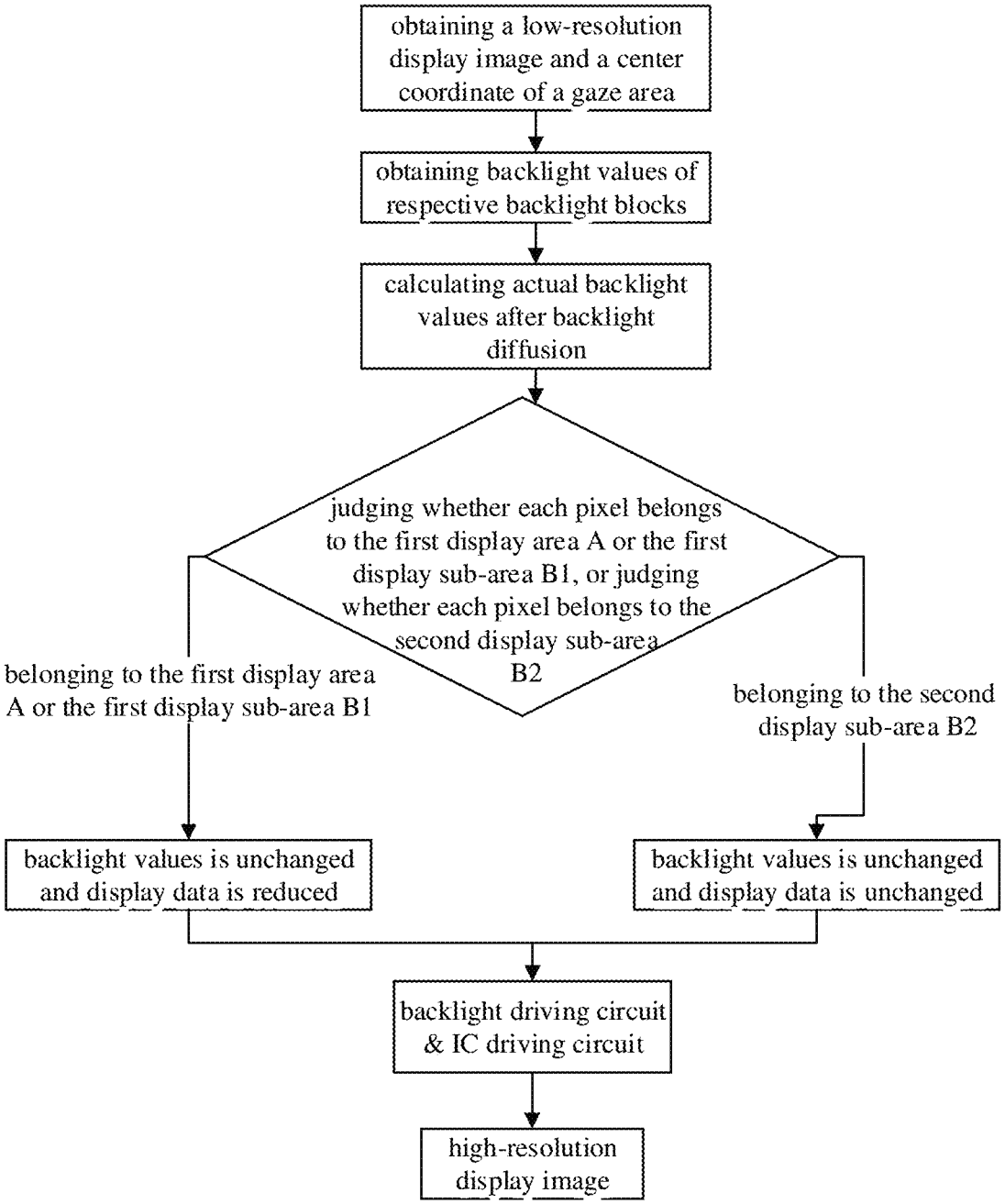
FIG. 6 is a flowchart of an example of an image display processing method provided by some embodiments of the present disclosure.
Figure 7:
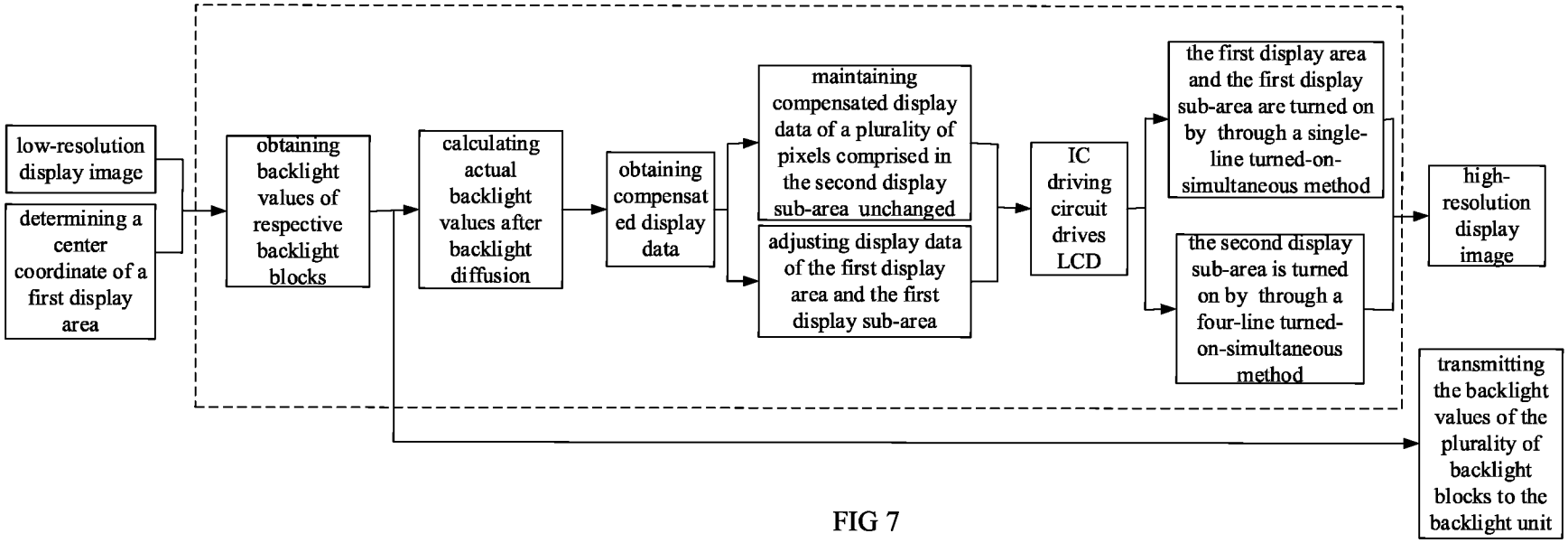
FIG. 7 is a schematic block diagram of an example of an image display processing method provided by some embodiments of the present disclosure.

FIG. 6 is a flowchart of some examples of an image display processing method provided by some embodiments of the present disclosure, and FIG. 7 is a schematic block diagram of some examples of an image display processing method provided by some embodiments of the present disclosure. The image display processing method provided by some embodiments of the present disclosure is systematically described in conjunction with FIG. 6 and FIG. 7.

It should be noted that, the embodiments of the present disclosure are described by taking a case that the a second display image with a display resolution of 1080*1080 and a first display image with a display resolution of 1440*1440 are input to the display panel with a physical resolution of 4320*4320 as an example, the embodiments of the present disclosure are not limited thereto, for details, the descriptions of FIG. 2B and FIG. 2C can be referred, and the details are not described herein again.

For example, first, a second display image having a display resolution of 1080*1080 is acquired. On one hand, backlight values of respective backlight blocks are obtained based on the display image, for example, the backlight values may be applied to the respective backlight blocks in the backlight unit through, for example, the LED drive circuit board as shown in FIG. 1B; on the other hand, the first display area is determined based on the center coordinate (that is, coordinate of the fixation point) (x, y), which is acquired by the SmartView technology, of the gaze point of the human eye in the display panel, for example, the first display area A (as shown in FIG. 2B) centered on the center coordinate (x, y) and comprising 1440 rows and 1440 columns of pixels and a high-resolution display image having a display resolution of 1440*1440 displayed in the first display area A are obtained.

Next, a backlight diffusion model is obtained based on the backlight values of the respective backlight blocks obtained by the above calculation, and actual backlight values after backlight in each backlight block is diffused are acquired based on the backlight diffusion model, so that the compensated display data of respective pixels of the display panel corresponding to each backlight block are acquired by formula (1) based on the actual backlight values.

Then, it is judged whether each pixel of the display image belongs to the first display area A or the first display sub-area B1 as shown in FIG. 3B, or it is judged whether each pixel of the display image belongs to the second display sub-area B2 as shown in FIG. 3B.

If the pixel belongs to the first display area A or the first display sub-area B1, the backlight values of the respective backlight blocks are kept unchanged, and the compensated display data of the first pixel or the second pixel in the display area is reduced. For example, the reduced compensated display data can be obtained by the formula (2), that is, the adjusted display data is obtained. The adjusted display data is used to drive the first display area A or the first display sub-area B1 in the display panel to display by, for example, the drive circuit that is configured to turn on a single row each time as shown in a left diagram of FIG. 1C.

If the pixel belongs to the second display sub-area B2, the compensated display data of at least one pixel comprised in the second display sub-area B2 is kept unchanged, and the compensated display data is used to drive the second display sub-area B2 in the display panel to display by, for example, the four-row turned-on-simultaneous drive circuit as shown in a right diagram of FIG. 1C.

Finally, a high-resolution display image having a display resolution of 1440*1440 can be displayed on the first display area A in the display panel, a low-resolution display image is displayed in the second display area B, so that the display panel reaches the display effect as shown in FIG. 11, thereby solving the phenomenon that the display brightness of the display panel as shown in FIG. 1D is uneven, and improving the display quality of the display panel.

For the step S140, there are different adjustment methods for the compensated display data of a plurality of sub-pixels comprised in the second display area B according to different division methods of respective sub-areas of the second display area B.

Figure 9:
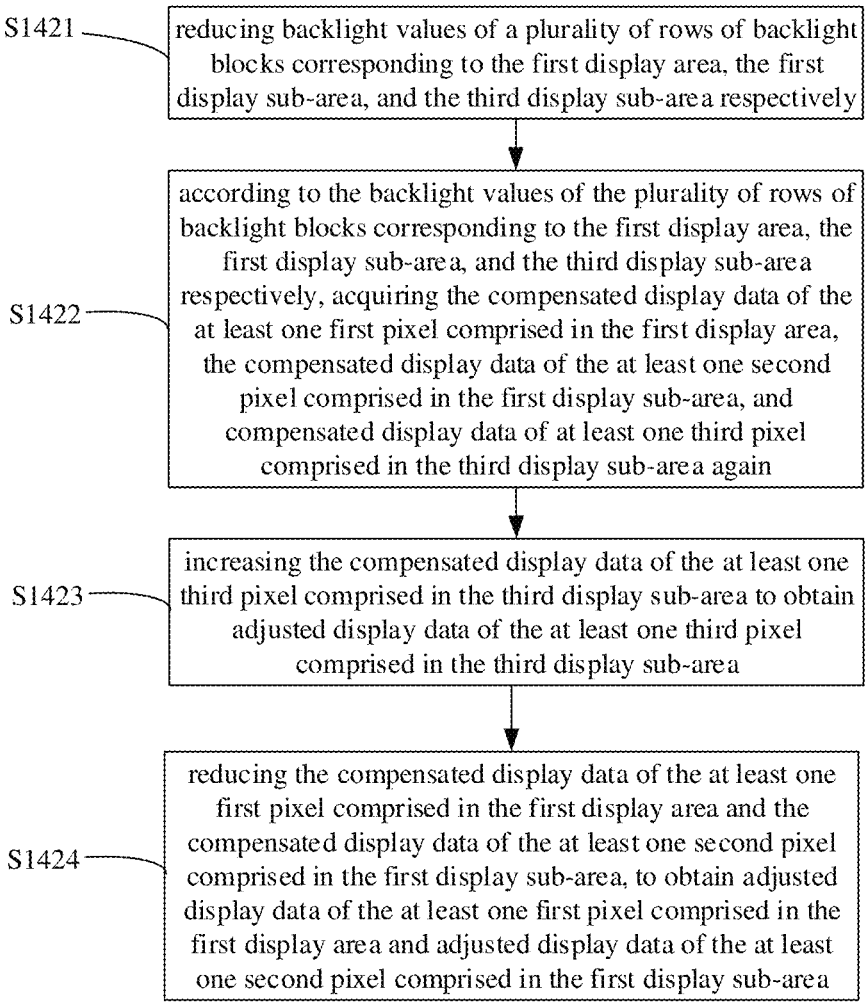
FIG. 9 is a flowchart of another example of acquiring adjusted display data provided by some embodiments of the present disclosure.

FIG. 8 is a schematic diagram of still another example of a first display area and a second display area provided by some embodiments of the present disclosure; and FIG. 9 is a flowchart of another method for acquiring adjusted display data provided by some embodiments of the present disclosure. That is, FIG. 9 is a flowchart of still other examples of steps S130 and S140 as shown in FIG. 3A. For example, in the example as shown in FIG. 9, the method for acquiring adjusted display data comprises steps S1421 to S1424. Hereinafter, an image display processing method of an embodiment of the present disclosure will be described with reference to FIG. 9.

Step S1421: reducing backlight values of a plurality of rows of backlight blocks corresponding to the first display area, the first display sub-area, and the third display sub-area, respectively.

Step S1422: according to the backlight values of the plurality of rows of backlight blocks corresponding to the first display area, the first display sub-area, and the third display sub-area respectively, acquiring the compensated display data of the at least one first pixel comprised in the first display area, the compensated display data of the at least one second pixel comprised in the first display sub-area, and compensated display data of at least one third pixel comprised in the third display sub-area again.

Step S1423: increasing the compensated display data of the at least one third pixel comprised in the third display sub-area to obtain adjusted display data of the at least one third pixel comprised in the third display sub-area.

Step S1424: reducing the compensated display data of the at least one first pixel comprised in the first display area and the compensated display data of the at least one second pixel comprised in the first display sub-area, to obtain adjusted display data of the at least one first pixel comprised in the first display area and adjusted display data of the at least one second pixel comprised in the first display sub-area.

For example, in this example, as shown in FIG. 8, the second display sub-area B2 further comprises a third display sub-area B3 and a fourth display sub-area B4. For example, the third display sub-area B3 and a boundary portion, which is adjacent to the second display sub-area B2, in the first display area A and the first display sub-area B1 correspond to a same row of backlight blocks (for example, as shown in FIG. 8, correspond to the same row of dotted-line boxes). For example, the fourth display sub-area B4 and the boundary portion, which is adjacent to the second display sub-area B2, in the first display area A and the first display sub-area B1 correspond to different backlight blocks, respectively.

For example, based on the division method of the display sub-areas as shown in FIG. 8, the backlight values of the backlight blocks and the compensated display data of the corresponding display areas can be simultaneously adjusted to improve the uniformity of the display brightness of the display panel.

For the step S1421, because the display brightness of the first display area A and the display brightness of the first display sub-area B1 are higher than the display brightness of the second display sub-area B2, thereby causing that the display brightness of the display panel is uneven, for example, the backlight values of the plurality of rows of backlight blocks respectively corresponding to the first display area A and the first display sub-area B1 may be reduced. Because the third display sub-area B3 and a boundary portion, which is adjacent to the third display sub-area B3, in the first display area A and the first display sub-area B1 are located in the same row of backlight blocks, that is, the backlight values of the backlight blocks corresponding to the third display sub-area B3 are also reduced.

For the step S1422, because the compensated display data of each display area is obtained based on the backlight values according to the formula (1), and therefore, in a case where the backlight values corresponding to the respective display areas are changed in step S1421, the compensated display data of the respective display areas needs to be determined again. For example, the specific process may be referred to the related description in step S120, and details are not described herein again.

For the step S1423, as can be seen from FIG. 1D, because the display brightness of the third display sub-area B3 is relatively low, in a case where the backlight values of the plurality of rows of the backlight blocks respectively corresponding to the first display area A and the first display sub-area B1, which have higher display brightness, are reduced in the step S1421, because the third display sub-area B3 and the boundary portion, which is adjacent to the third display sub-area B3, in the first display area A and the first display sub-area B1 are located in the same row of backlight blocks, therefore, while reducing the display brightness of the first display area A and the display brightness of the first display sub-area B1, the backlight values of the backlight blocks corresponding to the third display sub-area B3 are also reduced, so that after the compensated display data of the third display sub-area B3 is calculated in step S1422, in order to increase the display brightness of the third display sub-area B3 to enable the display brightness of the display panel more uniform, therefore, the compensated display data of the third pixel comprised in the third display sub-area B3 needs to be increased to obtain the adjusted display data of the third pixel comprised in the third display sub-area B3.

For example, a mapping relationship or a fit curve between the adjusted display data of the third pixel comprised in the third display sub-area B3 and the compensated display data of the third pixel comprised in the third display sub-area B3 may be re-determined according to the relevant introduction in step S1411, so as to determine the adjusted display data of the third pixel of the third display sub-area B3 according to the mapping relationship or the fit curve, and details are not described herein again.

For the step S1424, for example, the adjusted display data of the first pixel comprised in the first display area and the adjusted display data of the second pixel comprised in the first display sub-area may be calculated based on the formula (2) determined in the step S1411, the specific process may be referred to the step S1411, and details are not described herein again.

Figure 10:
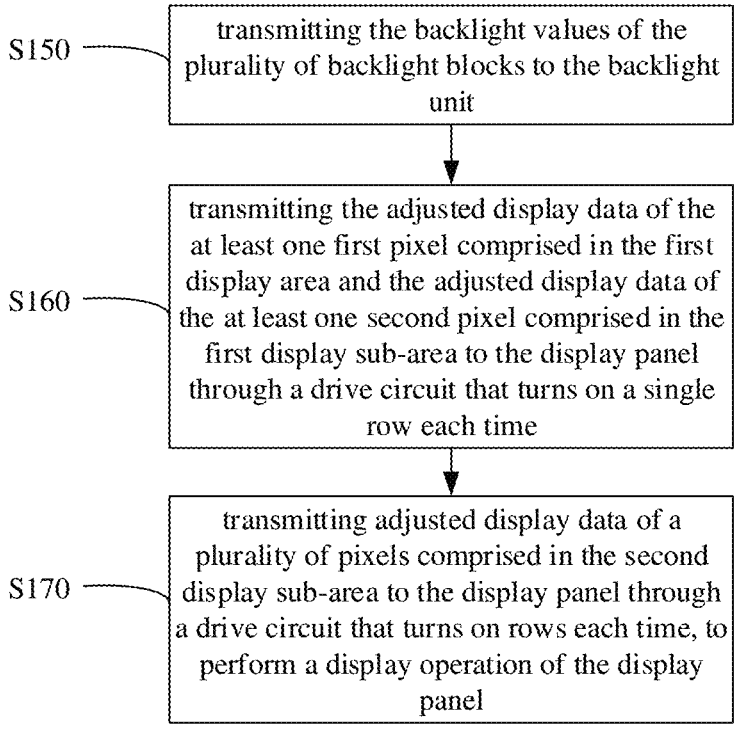
FIG. 10 is a flowchart of still another image display processing method provided by some embodiments of the present disclosure.

Some embodiments of the present disclosure also provides another image display processing method. As shown in FIG. 10, on the basis of the example as shown in FIG. 2A or FIG. 3A, the image display processing method further comprises steps S150 to S170. Hereinafter, an image display processing method of an embodiment of the present disclosure will be described with reference to FIG. 10.

Step S150: transmitting the backlight values of the plurality of backlight blocks to the backlight unit.

Step S160: transmitting the adjusted display data of the at least one first pixel comprised in the first display area and the adjusted display data of the at least one second pixel comprised in the first display sub-area to the display panel through a drive circuit that is configured to turn on a single row each time.

Step S170: transmitting adjusted display data of at least one pixel comprised in the second display sub-area to the display panel through a drive circuit that is configured to turn on rows each time, to perform a display operation of the display panel.

For the step S150, for example, the backlight values of the respective backlight blocks are input to, for example, a LED drive circuit board 13 as shown in FIG. 1B. The LED drive circuit board 13 generates drive currents for the respective backlight blocks based on the backlight values of the respective backlight blocks, and outputs the drive currents to the corresponding backlight blocks to control the LEDs in these backlight blocks to emit light through the currents.

For the step S160, for example, the adjusted display data is transmitted to a data driver of the display panel and transmitted to the corresponding pixel of the display panel through the data driver. The pixels comprised in the first display area and the first display sub-area in the display panel are turned on row by row under drive of, for example, a gate scan signal outputted by a drive circuit that is configured to turn on a single row each time as shown in left diagram of FIG. 1C, to control the deflection of the liquid crystal molecules of the liquid crystal layer in the corresponding pixel in the display panel according to the adjusted display data transmitted by the data driver, so that the light emitted by the backlight unit is transmitted, thereby displaying the display image on the display panel.

For the step S170, for example, every four rows of the pixels comprised in the second display area in the display panel are turned on simultaneously under drive of, for example, gate scan signals outputted by a four-row turned-on-simultaneous drive circuit as shown in the right diagram of FIG. 1C, to control the deflection of the liquid crystal molecules of the liquid crystal layer in the corresponding pixel in the display panel according to the adjusted display data transmitted by the data driver, so that the light emitted by the backlight unit is transmitted, thereby displaying the display image on the display panel.

It should be noted that, the flowchart of the image display processing method provided by some embodiments of the present disclosure may comprise more or less operations, and the operations may be performed sequentially or in parallel. Although the flowchart of the image display processing method described above comprises a plurality of operations occurring in a specific order, it should be clearly understood that, the order of the plurality of operations is not limited. The image display processing method described above may be performed once or may be performed a plurality of times according to predetermined conditions.

Figure 12:
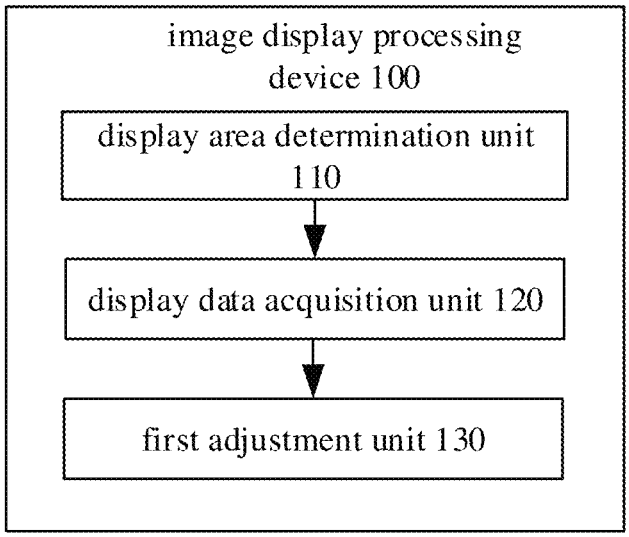
FIG. 12 is a schematic block diagram of an image display processing device provided by some embodiments of the present disclosure.

Some embodiments of the present disclosure also provide an image display processing device for a display device. For example, the display device comprises a display panel and a backlight unit, and the backlight unit comprises a plurality of backlight blocks and is driven in a local dimming mode. FIG. 12 is a schematic block diagram of an image display processing device provided by some embodiments of the present disclosure. For example, as shown in FIG. 12, in an example, the image display processing device 100 comprises a display area determination unit 110, a display data acquisition unit 120, and a first adjustment unit 130. For example, these units may be implemented in the form of hardware (such as, circuits) modules or software modules, and any combination thereof.

The display area determination unit 110 is configured to determine a first display area and a second display area of the display panel. For example, a display resolution of the first display area is larger than a display resolution of the second display area.

The display data acquisition unit 120 is configured to obtain backlight values of the plurality of backlight blocks, and calculate compensated display data of respective pixels of the display panel corresponding to the plurality of backlight blocks based on the backlight values of the plurality of backlight blocks.

The first adjustment unit 130 is configured to adjust compensated display data of at least one first pixel comprised in the first display area to obtain adjusted display data of the at least one first pixel.

For example, in another example, the image display processing device 100 further comprises a second adjustment unit (not shown in the drawing). For example, the second adjustment unit is configured to adjust compensated display data of at least one pixel comprised in the second display area to obtain adjusted display data of at least one pixel in the second display area.

It should be noted that, the image display processing device provided by the embodiments of the present disclosure may comprise more or fewer circuits or units, and the connection relationship among the respective circuits or units is not limited and may be determined according to actual needs. The specific configuration of each circuit is not limited, and may include an analog device according to the circuit principle, may also include digital chips, or other suitable manners.

Figure 13:
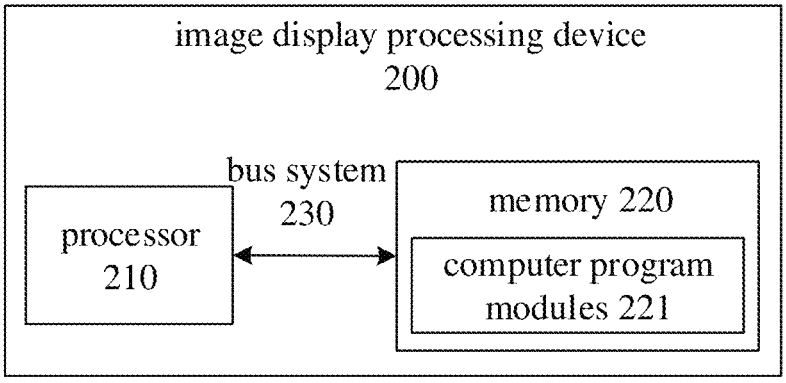
FIG. 13 is a schematic block diagram of another image display processing device provided by some embodiments of the present disclosure.

FIG. 13 is a schematic block diagram of another image display processing device provided by some embodiments of the present disclosure. As shown in FIG. 13, the image display processing device 200 comprises a processor 210, a memory 220, and one or more computer program modules 221.

For example, the processor 210 is connected with the memory 220 by a bus system 230. For example, the one or more computer program modules 221 are stored in the memory 220. For example, the one or more computer program modules 221 include instructions that are executable by a computer used for achieving the image display processing method provided by any one of the embodiments of the present disclosure. For example, the instructions of the one or more computer program modules 221 can be executed by the processor 210. For example, the bus system 230 is a serial or parallel communication bus, etc., and no limitation is imposed in this aspect in the embodiments of the present disclosure.

For example, the processor 210 may be a central processing unit (CPU), a field programmable logic gate array (FPGA), or other processing units with a data processing ability and/or instruction execution ability. For example, the processor 210 may be a general processor or a dedicated processor, and can control other components in the image display processing device 200 to achieve the expected functions.

For example, the memory 220 can include one or more computer program products, and the computer program products includes a computer-readable storage media in various forms, for example, includes a volatile storage and/or a non-volatile storage. The volatile storage, for example, includes a random access memory (RAM) and/or a cache memory, etc. The non-volatile storage, for example, includes a read-only memory (ROM), a hard disk, and a flash memory, etc. One or more computer program instructions can be stored in the computer-readable storage medium, and the processor 210 can run or execute the program instructions to achieve the functions (which are to be achieved by the processor 210) in the embodiments of the present disclosure and/or other expected functions, such as an image display processing method, etc. Various applications and data, such as a coordinate of the fixation point (x, y) and various data used and/or generated by application programs, etc., can also be stored in the computer-readable storage medium.

It should be noted that in order to be clear and concise, the embodiment of the present disclosure does not illustrate all components of the image display processing device 200. Those skilled in the art can provide and arrange other components, which are not illustrated in the figures, of the image display processing device 200 according to actual requirements to achieve necessary functions of the image display processing device 200, and the embodiment of the present disclosure is not limited thereto.

Technical effects of the image display processing device 100 and the image display processing device 200 in different embodiments can be referred to the technical effects of the image display processing method provided by at least one embodiment of the present disclosure, and details are not described here again.

Figure 14:
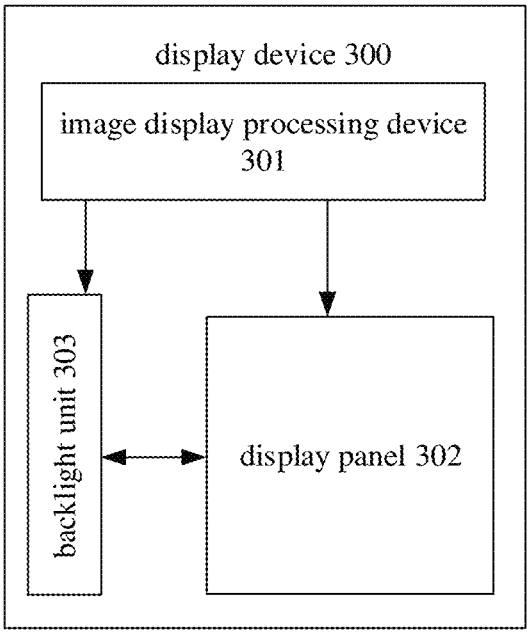
FIG. 14 is a schematic block diagram of a display device provided by some embodiments of the present disclosure.

At least one embodiment of the present disclosure also provides a display device, the display device comprises a display panel, a backlight unit, and an image display processing device provided by any one embodiment of the present disclosure. FIG. 14 is a schematic block diagram of a display device provided by some embodiments of the present disclosure. As shown in FIG. 14, a display device 300 comprises a display panel 302, a backlight unit 303, and an image display processing device 301 provided by any one embodiment of the present disclosure.

For example, the backlight unit 303 comprises a plurality of backlight blocks and is driven in a local dimming mode.

For example, the image display processing device 301 may be the image display processing device 100 as shown in FIG. 12 or the image display processing device 200 as shown in FIG. 13, and the embodiments of the present disclosure are not limited thereto.

For example, the image display processing device 301 generates backlight values and adjusted display data. The backlight values, for example, are transmitted to an LED drive circuit board in the backlight unit 303, thereby controlling LEDs in a corresponding backlight block of the backlight unit to emit light; in addition, the adjusted display data is transmitted to, for example, a drive chip (not shown in the drawing, for example, a data drive circuit) in the display panel 302 to control the deflection of the liquid crystal molecules of the liquid crystal layer in the display panel, so that the light emitted by the backlight unit 303 is transmitted, thereby displaying a display image on the display panel 302.

For example, the display device 300 may be a thin film transistor liquid crystal display device, an electronic paper display device, or the like. For example, the display device is a VR device, such as a VR helmet or the like, and the embodiments of the present disclosure are not limited to this case.

For example, these components are interconnected by a bus system and/or other coupling mechanisms (not shown in figures). For example, the bus system may be a conventional serial, parallel communication bus, etc., and the embodiments of the present disclosure are not limit to this case. It should be noted that the components and structures of the display device 300 as shown in FIG. 14 are merely exemplary and not limiting, and the display device 300 may include other components and structures as needed.

Technical effects of the display device 300 provided by some embodiments of the present disclosure can be referred to the corresponding descriptions of the image display processing method in the above embodiments, and details are not described herein again.

Figure 15:
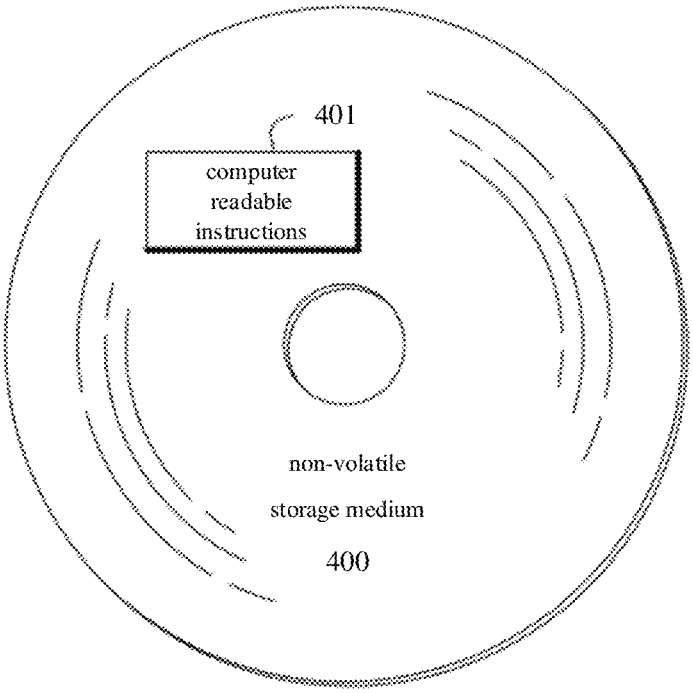
FIG. 15 is a schematic diagram of a non-volatile storage medium provided by some embodiments of the present disclosure.

Some embodiments of the present disclosure also provide a non-volatile storage medium. FIG. 15 is a schematic diagram of a non-volatile storage medium provided by some embodiments of the present disclosure. For example, the non-volatile storage medium 400 non-temporarily stores computer readable instructions 401, the image display processing method provided by any one of the embodiments of the present disclosure may be performed when the non-volatile computer readable instructions 401 are executed by a computer (comprising a processor).

For example, the non-volatile storage medium may be any combination of one or more computer-readable storage media. For example, one computer-readable storage medium includes computer-readable program codes used for determining the compensated display data, and another computer-readable storage medium includes computer-readable program codes used for obtaining the adjusted display data. For example, in a case where the program codes are read by the computer, the program codes stored in the computer-readable storage medium are executed by the computer, and for example, the image display processing method provided by any one of the embodiments of the present disclosure is performed.

For example, the non-volatile storage medium may include a memory card of a smart phone, a storage component of a tablet, a hard disk of a personal computer, a random access memory (RAM), a read-only memory (ROM), an erasable programmable read-only memory (EPROM), a portable compact disk read-only memory (CD-ROM), a flash memory, or any combination of the above-mentioned storage media, may also be other suitable storage media.

Technical effects of the storage medium provided by the embodiments of the present disclosure can be referred to the corresponding descriptions of the image display processing method in the above embodiments, and details are not described herein again.

The following should be noted:

1) Only the structures involved in the embodiments of the present disclosure are illustrated in the drawings of the embodiments of the present disclosure, and other structures can refer to usual designs.

(2) The embodiments and features in the embodiments of the present disclosure may be combined in case of no conflict to obtain new embodiments.

What have been described above merely are exemplary embodiments of the disclosure, and not intended to define the scope of the disclosure, and the scope of the disclosure is determined by the appended claims.

What is claimed is:

1. An image display processing method for a display device, wherein the display device comprises a display panel and a backlight unit, the backlight unit comprises a plurality of backlight blocks and is driven in a local dimming mode, and the image display processing method comprises:

determining a first display area and a second display area of the display panel;

for a frame display image, obtaining backlight values of the plurality of backlight blocks in a case of displaying the frame display image, and calculating compensated display data of respective pixels of the display panel corresponding to the plurality of backlight blocks based on the backlight values of the plurality of backlight blocks; and adjusting compensated display data of at least one first pixel comprised in the first display area to obtain adjusted display data of the at least one first pixel, wherein a display resolution of the first display area is larger than a display resolution of the second display area;

the second display area comprises a first display sub-area and a second display sub-area, the first display sub-area and the first display area are in a same row, the second display sub-area and the first display area are in different rows;

the second display sub-area comprises a third display sub-area and a fourth display sub-area;

the third display sub-area and a boundary portion, which is adjacent to the second display sub-area, in the first display area and the first display sub-area correspond to a same row of backlight blocks; and the fourth display sub-area and the boundary portion, which is adjacent to the second display sub-area, in the first display area and the first display sub-area correspond to different rows of backlight blocks, respectively.

2. The image display processing method according to claim 1, further comprising:

adjusting compensated display data of at least one pixel comprised in the second display area to obtain adjusted display data of the at least one pixel in the second display area.

3. The image display processing method according to claim 2, wherein adjusting the compensated display data of the at least one first pixel comprised in the first display area and the compensated display data of the at least one pixel comprised in the second display area comprises:

reducing the compensated display data of the at least one first pixel comprised in the first display area and compensated display data of at least one second pixel comprised in the first display sub-area to obtain the adjusted display data of the at least one first pixel and adjusted display data of the at least one second pixel, respectively, wherein the at least one pixel comprised in the second display area comprises the at least one second pixel of the first display sub-area.

4. The image display processing method according to claim 3, wherein reducing the compensated display data of the at least one first pixel comprised in the first display area and the compensated display data of at least one second pixel comprised in the first display sub-area comprises:

obtaining a mapping relationship between adjusted display data of respective pixels of the display panel and compensated display data of the respective pixels of the display panel; and acquiring, according to the mapping relationship, the adjusted display data of the at least one first pixel comprised in the first display area and the adjusted display data of the at least one second pixel comprised in the first display sub-area.

5. The image display processing method according to claim 4, wherein the mapping relationship is expressed as:

$$f(LCD_{com}) = \begin{cases} \sum_{i=0}^{n} a_i LCD_{com}^i & LCD_{com} < \frac{Hm}{2} \\ \sum_{i=0}^{n} b_i LCD_{com}^i & LCD_{com} \geq \frac{Hm}{2} \end{cases}$$

wherein f ($LCD_{com}$) represents adjusted display data of a pixel of the at least one first pixel comprised in the first display area or adjusted display data of a pixel of the at least one second pixel comprised in the first display sub-area, $LCD_{com}$ represents compensated display data of the pixel, $a_i$ and $b_i$ represent adjustment coefficients of display data in different gray scale ranges, Hm represents a highest gray scale displayed by the pixel, i is an integer greater than or equal to 0 and less than or equal to n, and n is an integer greater than 1.

6. The image display processing method according to claim 5, wherein the compensated display data of the pixel is expressed as:

$$LCD_{com} = LCD_{ori} * \left(\frac{Hm}{BL_{PIX}}\right)^{1/2.2}$$

wherein $LCD_{ori}$ represents display data before compensation of the pixel, and $BL_{PIX}$ represents an actual backlight value corresponding to the pixel and obtained by a backlight diffusion model.

7. The image display processing method according to claim 3, wherein adjusting the compensated display data of the at least one pixel comprised in the second display area further comprises:

maintaining compensated display data of at least one pixels comprised in the second display sub-area unchanged.

8. The image display processing method according to claim 1, wherein adjusting the compensated display data of the at least one first pixel comprised in the first display area and the compensated display data of the at least one pixel comprised in the second display area comprises:

reducing backlight values of a plurality of rows of backlight blocks corresponding to the first display area, the first display sub-area, and the third display sub-area respectively;

according to the backlight values of the plurality of rows of backlight blocks corresponding to the first display area, the first display sub-area, and the third display sub-area respectively, acquiring the compensated display data of the at least one first pixel comprised in the first display area, the compensated display data of the at least one second pixel comprised in the first display sub-area, and compensated display data of at least one third pixel comprised in the third display sub-area again;

increasing the compensated display data of the at least one third pixel comprised in the third display sub-area to obtain adjusted display data of the at least one third pixel comprised in the third display sub-area; and reducing the compensated display data of the at least one first pixel comprised in the first display area and the compensated display data of the at least one second pixel comprised in the first display sub-area, to obtain adjusted display data of the at least one first pixel comprised in the first display area and adjusted display data of the at least one second pixel comprised in the first display sub-area.

9. The image display processing method according to claim 1, further comprising:

maintaining compensated display data of at least one pixel comprised in the fourth display sub-area and backlight values of at least one row of backlight blocks corresponding to the fourth display sub-area unchanged.

10. The image display processing method according to claim 8, further comprising:

maintaining compensated display data of at least one pixel comprised in the fourth display sub-area and backlight values of at least one row of backlight blocks corresponding to the fourth display sub-area unchanged.

11. The image display processing method according to claim 3, further comprising:

transmitting the backlight values of the plurality of backlight blocks to the backlight unit;

transmitting the adjusted display data of the at least one first pixel comprised in the first display area and the adjusted display data of the at least one second pixel comprised in the first display sub-area to the display panel through a drive circuit that is configured to turn on a single row each time; and transmitting adjusted display data of at least one pixel comprised in the second display sub-area to the display panel through a drive circuit that is configured to turn on rows each time, to perform a display operation of the display panel.

12. An image display processing device for a display device, wherein the display device comprises a display panel and a backlight unit, the backlight unit comprises a plurality of backlight blocks and is driven in a local dimming mode, the image display processing device comprises a display area determination unit, a display data acquisition unit, and a first adjustment unit;

the display area determination unit is configured to determine a first display area and a second display area of the display panel;

the display data acquisition unit is configured to obtain backlight values of the plurality of backlight blocks, and calculate compensated display data of respective pixels of the display panel corresponding to the plurality of backlight blocks based on the backlight values of the plurality of backlight blocks; and the first adjustment unit is configured to adjust compensated display data of at least one first pixel comprised in the first display area to obtain adjusted display data of the at least one first pixel, wherein a display resolution of the first display area is larger than a display resolution of the second display area;

the second display area comprises a first display sub-area and a second display sub-area, the first display sub-area and the first display area are in a same row, the second display sub-area and the first display area are in different rows;

the second display sub-area comprises a third display sub-area and a fourth display sub-area;

the third display sub-area and a boundary portion, which is adjacent to the second display sub-area, in the first display area and the first display sub-area correspond to a same row of backlight blocks; and the fourth display sub-area and the boundary portion, which is adjacent to the second display sub-area, in the first display area and the first display sub-area correspond to different rows of backlight blocks, respectively.

13. The image display processing device according to claim 12, further comprising a second adjustment unit, wherein the second adjustment unit is configured to adjust compensated display data of at least one pixel comprised in the second display area to obtain adjusted display data of the at least one pixel in the second display area.

14. The image display processing device according to claim 13, wherein the first adjustment unit is configured to reduce the compensated display data of the at least one first pixel comprised in the first display area to obtain the adjusted display data of the at least one first pixel, and the second adjustment unit is configured to reduce compensated display data of at least one second pixel comprised in the first display sub-area to obtain adjusted display data of the at least one second pixel, wherein the at least one pixel comprised in the second display area comprises the at least one second pixel of the first display sub-area.

15. An image display processing device for a display device, comprising:

a processor;

and a memory, storing one or more computer program modules, wherein the one or more computer program modules are configured to be executed by the processor, and the one or more computer program modules comprise instructions for performing the image display processing method according to claim 1.

16. A display device, comprising the image display processing device according to claim 12.

17. The display device according to claim 16, further comprising: the display panel and the backlight unit, wherein the backlight unit comprises a plurality of backlight blocks and is driven in a local dimming mode; and the display panel is configured to display an image according to adjusted display data obtained by the image display processing device.

18. A display device, comprising the image display processing device according to claim 15.

19. A non-volatile storage medium, storing computer readable instructions non-temporarily, wherein the image display processing method according to claim 1 is performed when the computer readable instructions are executed by a computer.

* * * * *